US008733597B2

(12) United States Patent
Fitzpatrick et al.

(10) Patent No.: US 8,733,597 B2
(45) Date of Patent: May 27, 2014

(54) LIQUID DISPENSER

(75) Inventors: Kevin Thomas Fitzpatrick, Winchester, VA (US); Bryan Scott Ritchie, Clear Brook, VA (US); Matthew Scott Kepner, Stephens City, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 174 days.

(21) Appl. No.: 13/289,203

(22) Filed: Nov. 4, 2011

(65) Prior Publication Data

US 2012/0111895 A1 May 10, 2012

Related U.S. Application Data

(60) Provisional application No. 61/410,622, filed on Nov. 5, 2010.

(51) Int. Cl.
*B05B 1/08* (2006.01)
*F04B 43/12* (2006.01)

(52) U.S. Cl.
USPC ..... 222/214; 417/476; 417/412

(58) Field of Classification Search
USPC ..... 222/207, 181.1, 181.3, 80, 325, 214; 417/476, 412, 477.1, 477.3, 477.6, 417/477.11, 474, 475
See application file for complete search history.

(56) References Cited

U.S. PATENT DOCUMENTS

| | | | | | |
|---|---|---|---|---|---|
| 2,668,637 | A * | 2/1954 | Gilmore | 222/95 |
| 3,750,908 | A * | 8/1973 | Bauerlein et al. | 222/80 |
| 4,214,681 | A * | 7/1980 | Levine | 222/214 |
| 4,232,828 | A * | 11/1980 | Shelly, Jr. | 239/329 |
| 4,513,885 | A * | 4/1985 | Hogan | 222/95 |
| 4,690,307 | A * | 9/1987 | Hogan | 222/95 |
| 5,105,992 | A * | 4/1992 | Fender et al. | 222/52 |
| 5,265,772 | A | 11/1993 | Bartasevich et al. | |
| 6,189,740 | B1 * | 2/2001 | Wade et al. | 222/207 |
| 7,527,171 | B2 | 5/2009 | Ophardt et al. | |
| 8,220,665 | B2 * | 7/2012 | Laible | 222/181.1 |
| 8,261,941 | B2 * | 9/2012 | Woo et al. | 222/52 |
| 2005/0263545 | A1 * | 12/2005 | Ophardt | 222/477 |
| 2011/0056987 | A1 * | 3/2011 | Proper et al. | 222/153.13 |

OTHER PUBLICATIONS

International Searching Authority, Written Opinion issued for International application No. PCT/US2011/059391, Mar. 9, 2012.
International Searching Authority, International Search Report issued for International application No. PCT/US2011/059391, Mar. 9, 2012.

* cited by examiner

*Primary Examiner* — Paul R Durand
*Assistant Examiner* — Charles P Cheyney
(74) *Attorney, Agent, or Firm* — Dennis J. Williamson; Moore and Van Allen PLLC

(57) ABSTRACT

The liquid dispenser comprises a ratchet assembly, a rotor assembly, a reservoir assembly, and a drive mechanism. The reservoir assembly includes a reservoir and a reservoir tube; and the rotor assembly includes a drive gear and at least one compression element. The ratchet assembly includes a pawl configured to engage the drive gear when the drive mechanism is actuated. Optionally, the liquid dispenser includes a venting assembly and/or a dose control assembly. The venting assembly automatically vents the reservoir when the reservoir is mounted in the liquid dispenser. The dose control assembly allows the user to control the distance the drive mechanism may be actuated and thereby control the amount of liquid that is dispensed. The liquid dispenser of the invention provides accurate control over the amount of liquid that is dispensed as well as ease in replacing the reservoir.

17 Claims, 30 Drawing Sheets

LIQUID DISPENSER

CLAIM OF PRIORITY UNDER 35 U.S.C. §119

The present Application for Patent claims priority to U.S. Provisional Patent Application No. 61/410,622, entitled "LIQUID DISPENSER" filed Nov. 5, 2010, and assigned to the assignee hereof and hereby expressly incorporated by reference herein.

FIELD OF THE INVENTION

The invention relates generally to a dispenser such as a liquid dispenser and more particularly to an improved liquid dispenser for dispensing consistent amounts of liquid.

BACKGROUND OF THE INVENTION

In a standard liquid dispenser, a liquid is pumped by one of many means. Particularly for liquids containing a coarse grit material, the method of pumping is with a diaphragm pump, tube pump (where the tube is compressed to seal then push fluid out), and piston pumps.

In some situations, accurate measurement of liquids is desirable when dispensing the liquids. Too little liquid may be insufficient to sanitize the object receiving the liquid. Too much liquid is wasteful and increases cost. Standard liquid dispensers do not provide an accurate means of controlling the amount of liquid that is dispensed. In diaphragm and tube pumps, the pumps swell as they are being compressed which allows some of the fluid in the pump to remain, resulting in pumps that are inefficient at controlling the volume of fluid. Even with dosage control mechanisms, the pumps cannot consistently deliver an appropriate amount of liquid. Piston pumps do not effectively deliver grit soaps because the piston/cylinder assembly wears unpredictably and may leak or not pump efficiently.

Finally, bag-in-box type fluid reservoirs, which have some form of plastic liner and cardboard exterior package (bag-in-box), do not evacuate efficiently because the bag can fold on itself and trap fluid not allowing it to be pumped from the bag.

SUMMARY OF THE INVENTION

According to one embodiment of the invention, the liquid dispenser of the invention comprises a ratchet assembly, a rotor assembly, a reservoir assembly, and a drive mechanism. The reservoir assembly includes a reservoir for holding the liquid, and a reservoir tube, from which the liquid is dispensed. The rotor assembly includes a drive gear and at least one roller. The ratchet assembly includes a pawl that is configured to engage the drive gear and cause the rotor assembly to rotate. When the rotor assembly rotates, the roller(s) compresses the reservoir tube and forces liquid out of the liquid dispenser. In some embodiments, the liquid dispenser includes a dose control assembly that allows the user to control the amount of liquid that is dispensed during drive mechanism actuation. The liquid dispenser may also include a venting assembly that is configured to automatically vent the reservoir when the reservoir is mounted in the liquid dispenser. The reservoir can also be a flexible or soft container that will collapse on itself as liquid is dispensed. The liquid dispenser may also include a backlash ratchet that prevents the rotor assembly from rotating in a reverse direction. In use, the liquid dispenser provides for accurate amounts of liquid to be dispensed, control over the amount of liquid that is dispensed, and ease in replacing the reservoir assembly.

Finally, the rotor assembly can be driven by electromechanical means instead of being driven by a user manually pushing the handle. A sensor can be used to sense the presence of a user's hand in proximity to the dispenser. This sensor, when triggered, would complete a circuit and trigger a motor to rotate the rotor assembly a specified rotational angle.

DETAILED DESCRIPTION OF EMBODIMENTS OF THE INVENTION

Figure 1:
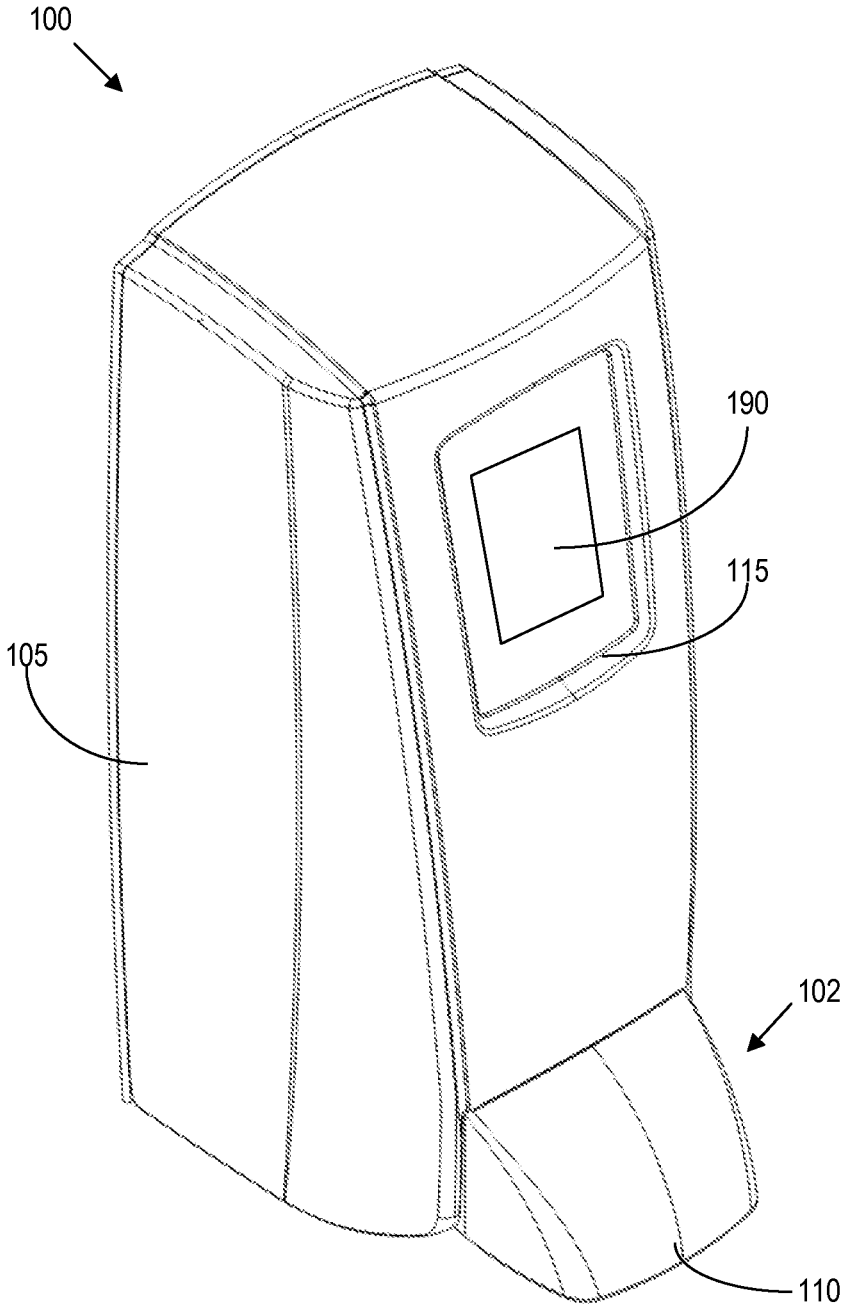
FIG. 1 is a perspective view of an embodiment of the liquid dispenser of the invention.

One embodiment of the liquid dispenser 100 of the invention is shown generally in FIGS. 1-4 and comprises a drive mechanism 102 and a casing 105 enclosing a rotor assembly 140, at least one ratchet assembly 155, a saddle assembly 180, and a reservoir assembly 485. In operation, when the drive mechanism 102 is actuated, the ratchet assembly 155 is advanced causing the rotor assembly 140 to rotate. A reservoir tube 175 is compressed between the rotating rotor assembly 140 and the saddle assembly 180, dispensing liquids from the reservoir assembly 485 using a peristaltic-type motion. In some embodiments, the liquid dispenser 100 further comprises a dose control assembly 160 and a venting assembly 195. In combination, the components of the liquid dispenser 100 provide a reliable system for dispensing accurate amounts of liquids, such as soaps. While the application will refer to dispensing liquids, it should be understood that any flowable material may be dispensed from the liquid dispenser 100, including gels, pastes, and low density solids.

As disclosed in FIG. 1, in an exemplary embodiment the drive mechanism 102 is a manually-actuated handle 110. In some embodiments, the handle 110 protrudes from the bottom of the casing 105 for ease of actuation. In an embodiment, a user actuates the handle 110 with the user's palm and discharges soap into the user's fingers. The casing 105 and handle 110 can be manufactured of injection-molded plastic, metal, or other generally inflexible material. In other embodiments (not shown), the drive mechanism 102 is an electromechanical actuation triggered by a sensor. A sensor is used to sense the presence of a user's hand in proximity to the dispenser. The sensor, when triggered, would complete a circuit and trigger a motor to rotate the rotor assembly a specified rotational angle.

In some embodiments, the casing 105 further includes a window 115. The window 115 may be open to disclose the interior of the liquid dispenser 100. In other embodiments, the window 115 is solid and transparent. The window 115 may be positioned so that an information display 190 on the reservoir assembly 485 can be read without removing the casing 105 from the liquid dispenser 100. The information display 190 may disclose the contents of the reservoir assembly 485, warnings relative to the contents, the expiration date of the reservoir assembly 485, the amount remaining in the reservoir assembly 485, etc.

Figure 2:
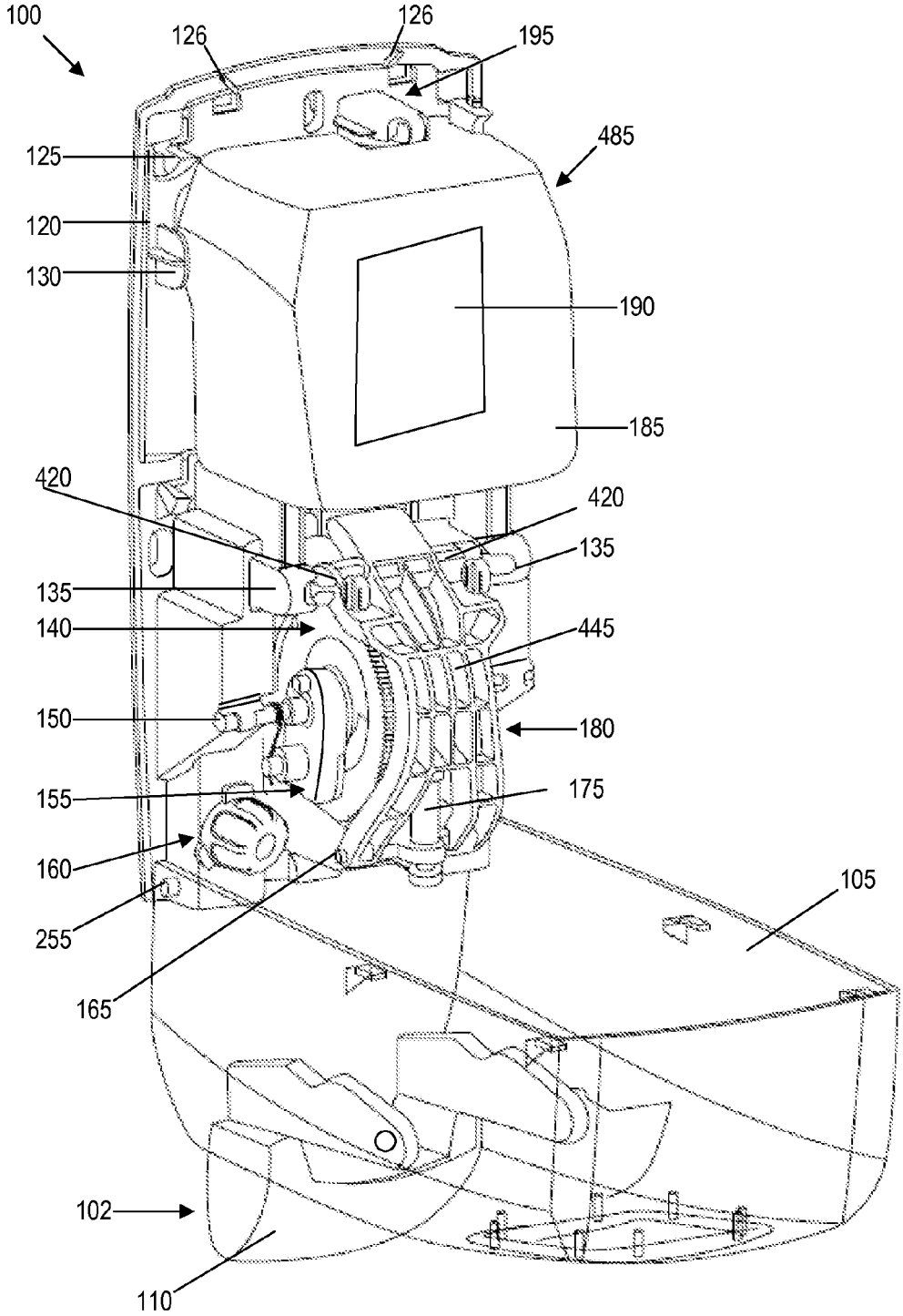
FIG. 2 is a perspective view of the liquid dispenser of FIG. 1 with the casing rotated away from the backing
Figure 3:
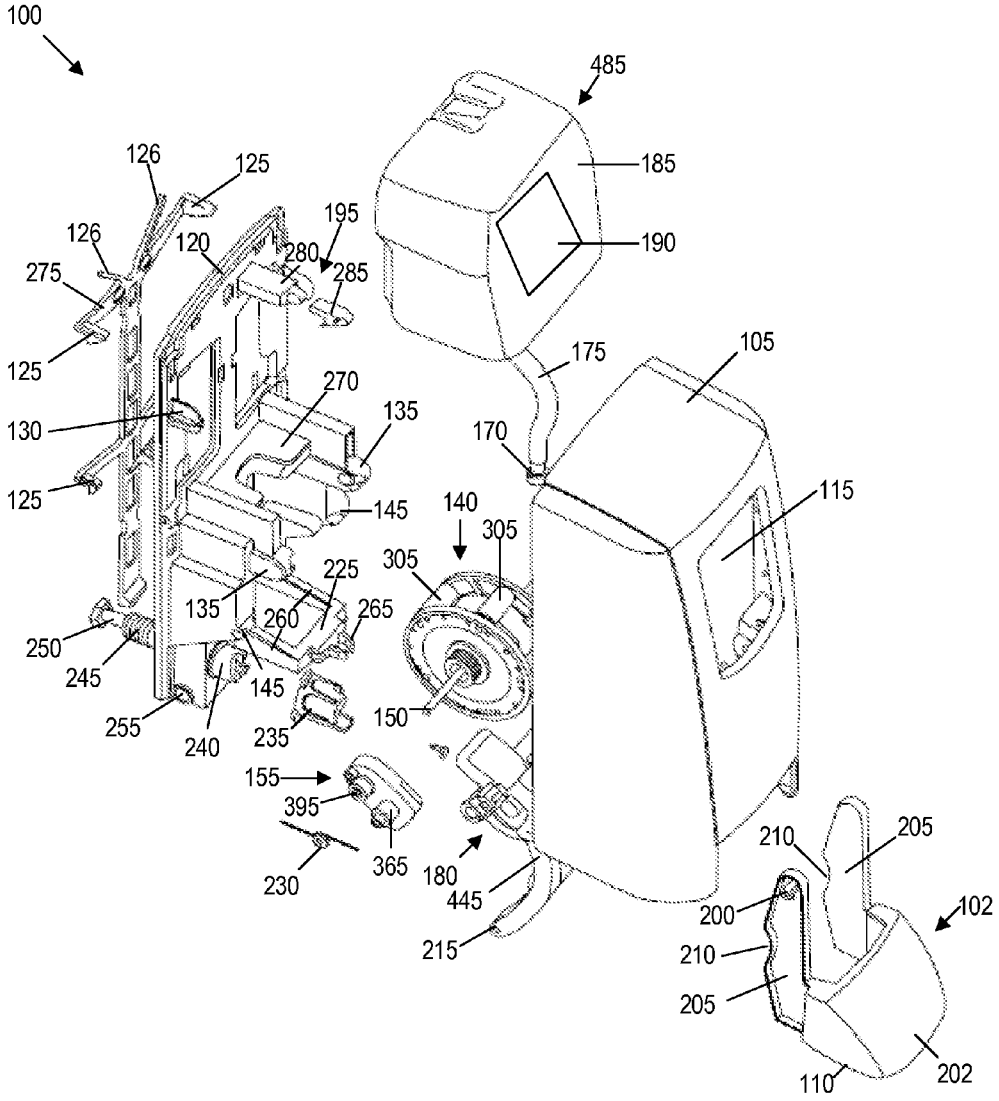
FIG. 3 is an exploded perspective view of the liquid dispenser of FIG. 1 from a first angle.
Figure 4:
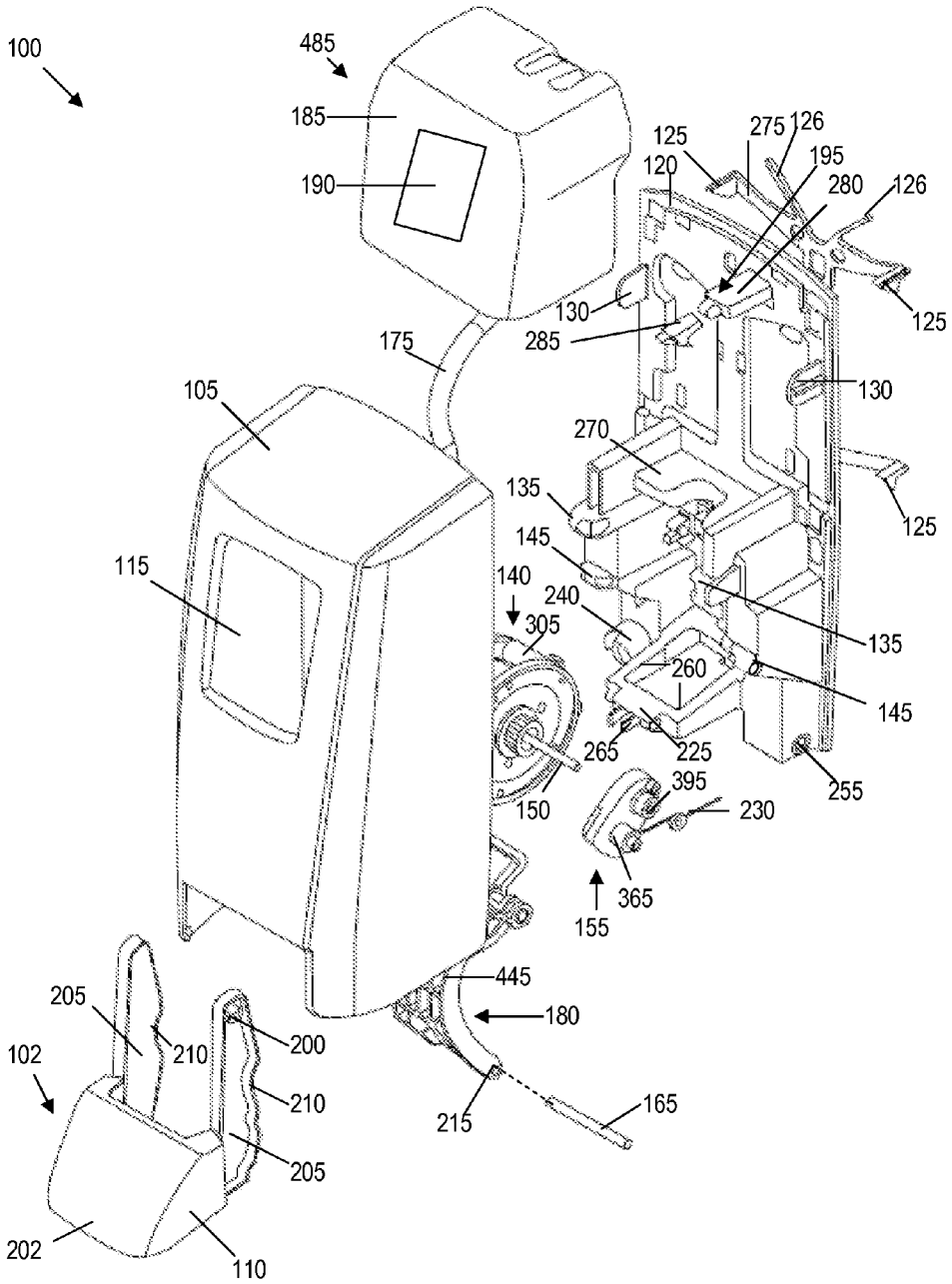
FIG. 4 is an exploded perspective view of the liquid dispenser of FIG. 1 from a second angle.

Turning now to FIGS. 3 and 4, exploded perspective views of the liquid dispenser 100 are provided. In some embodiments, a locking mechanism 275 is provided with the liquid dispenser 100 for holding the casing 105 substantially adjacent to a backing 120. The locking mechanism 275 comprises casing locks 125 that secure to connectors on the casing 105. In some embodiments, the casing locks 125 include hooks that enter holes in the backing 120 and prevent the casing 105 from being pulled straight off of the locking mechanism 275. In this manner, the casing 105 is secured in a position substantially adjacent the backing 120 and enclosing the reservoir assembly 485, the rotor assembly 140, the saddle assembly 180, and the ratchet assembly 155. In some embodiments, a pair of casing prongs 126 secures the casing locks 125 in the casing 105. To unlock the casing 105 from the backing 120, the base of the locking mechanism 275 is pushed upward causing the prongs 126 at the top of the locking mechanism 275 to flex. The casing locks 125 can then be disengaged from the casing 105. In some embodiments, the casing 105 attaches to a casing pivot 255 on either side of the backing 120 and rotates between a position substantially adjacent the backing 120, as shown in FIG. 1, and a position remote from or tilted away from the backing 120, as shown in FIG. 2. This allows the interior components of the liquid dispenser 100 to be accessed. It should be understood that the casing 105 may be removed from the backing 120 in other ways. For example, the casing 105 may swing to the left, right, or above. The casing 105 may also be completely removable from the backing 120 using snap fit connectors or screws.

FIGS. 3 and 4 depict the handle 110 detached from the casing 105. The handle 110 removably attaches to the interior of the casing 105 at handle pivots 200. Handle arms 205 extend from the handle pivots 200 to a handle face 202. The handle pivots 200 allow the handle 110 to move between a neutral position (shown in FIGS. 1, 25A, and 25B) and an actuated position (shown in FIGS. 27A and 27B). When the handle 110 is moved into the actuated position, the handle arms 205 advance the ratchet assemblies 155 and ultimately cause liquid to be dispensed. In some embodiments, the handle arms 205 comprise a handle recess 210 that contacts the ratchet assemblies 155. The handle recesses 210 contact the ratchet assemblies 155 as the handle 110 is actuated. The portion of the handle 110 that contacts the ratchet assemblies 155 may also be straight or convex. In an embodiment, the handle face 202 protrudes slightly from the casing 105, although the handle face 202 may also be flush with or recessed into the casing 105.

As shown in FIGS. 2, 3, and 4, the interior components of the liquid dispenser 100 can be seen when the casing 105 is pivoted away or removed from the backing 120. The backing 120 is configured to receive each of the components and secure them relative to one another. For example, the reservoir assembly 485 comprises a reservoir 185 configured to contain a liquid and a reservoir tube 175 configured to dispense the liquid from the reservoir 185. The individual elements of the reservoir assembly 485 will be discussed later with respect to FIG. 16. The reservoir 185 removably attaches to the backing 120 between reservoir brackets 130. The reservoir brackets 130 center the reservoir 185 in the backing 120. The reservoir tube 175 extends from the reservoir 185, passes between the saddle assembly 180 and the rotor assembly 140, to a position where liquid may be discharged from the liquid dispenser 100. The reservoir tube 175 may be removably secured to the backing 120 by means of a reservoir clip 265, shown in FIGS. 3, 4, and 13. In other embodiments, the reservoir tube 175 attaches to the backing 120 by means of an elastic band, passes through a hole formed in the casing 105, or snaps into the casing 105 by means of another attachment device.

Figure 22A:
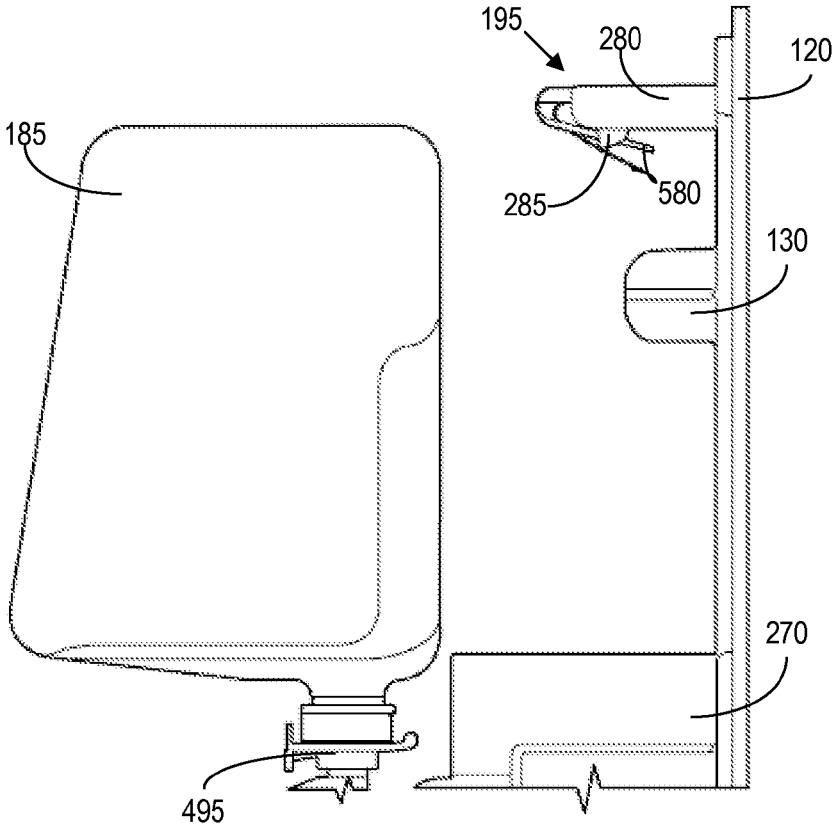
FIG. 22A is a side view of the venting assembly of FIG. 21 before attaching the reservoir.
Figure 22B:
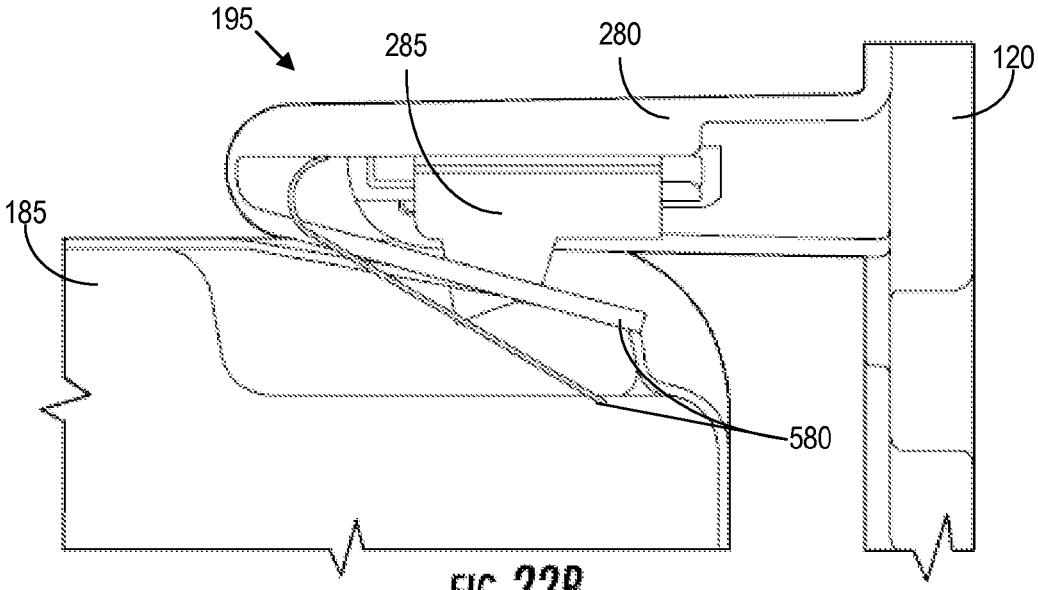
FIG. 22B is a side view of the venting assembly of FIG. 21 after attaching the reservoir.

FIGS. 3 and 4 show that an empty reservoir 185 can be removed from a cradle 270 in the backing 120 when the casing 105 is removed from the backing 120. A new reservoir 185, such as a full reservoir or a reservoir containing a different type of liquid, can be installed in the cradle 270. The reservoir tube 175 descends below the reservoir 185 and attaches to the reservoir clip 265. In some embodiments, when the reservoir 185 is placed in the cradle 270 the venting assembly 195 automatically vents the reservoir 185, as shown in FIGS. 22A and 22B. The venting assembly 195 comprises a venting body 280 that holds a venting blade 285, wherein the venting blade pierces the reservoir 185 when placed in the cradle 270. In one embodiment, the cradle 270 supports the reservoir 185 from the bottom of the reservoir 185. The cradle 270 may also support the reservoir 185 from the sides or from the top. The cradle 270 may also slide into rails positioned vertically on the backing 120 so that the reservoir 185 is lifted vertical for removal.

Figure 16:
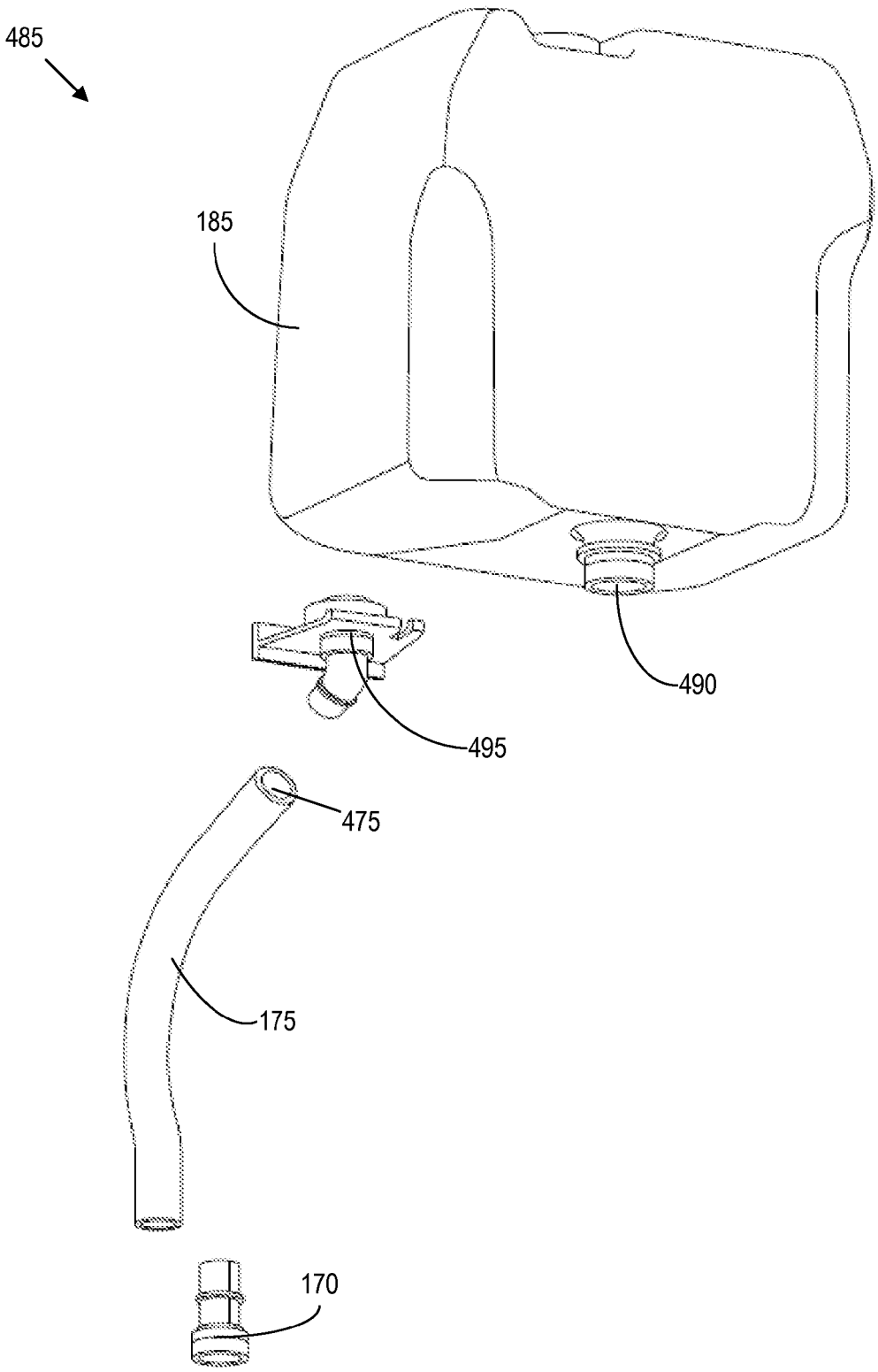
FIG. 16 is a perspective view of the reservoir assembly for the liquid dispenser of FIG. 1.

Turning now to FIG. 16, the individual components of the reservoir assembly 485 are shown in an exploded view. The reservoir assembly 485 comprises the reservoir 185, the reservoir tube 175, an adaptor nozzle 495, and a check valve 170. In an embodiment, the reservoir assembly is self-contained and does not require liquid to pass through other sections of the liquid dispenser 100. This allows the other portions of the liquid dispenser 100 to remain clean while the reservoir 185 is replaced. In another embodiment, the reservoir assembly 485 includes an opening (not shown) that allows the reservoir 185 to be refilled and re-used. The reservoir 185 is sized to be received within the backing 120 and can be configured to receive any volume of liquids. In an exemplary embodiment, the reservoir 185 is rigid and manufactured from hard plastic or metal. In another embodiment (not shown), the reservoir 185 is manufactured from a flexible material, such as a soft plastic. When the reservoir 185 is manufactured from a flexible material, the reservoir 185 will shrink or collapse on itself as liquid is pumped out of the reservoir 185.

The reservoir tube 175 is generally round in cross-section, although the reservoir tube may have any cross-sectional shape. For example, in an embodiment the reservoir tube 175 is generally oval in cross-section and thus less likely to move laterally when compressed against the saddle body 445. The reservoir tube 175 includes a lumen 475 through which the liquid passes when being dispensed from the reservoir 185. The diameter of the lumen 475 affects the amount of liquid that is dispensed from the liquid dispenser 100. A user can use reservoir tubes 175 having different lumen 475 diameters to dispense different amounts of liquid for the same actuation distance of the handle 110. In an embodiment, a reservoir tube 175 can be switched out by detaching the adaptor nozzle 495 and attaching a new adaptor nozzle 495 and reservoir tube 175 with a different diameter lumen 475.

Figure 13:
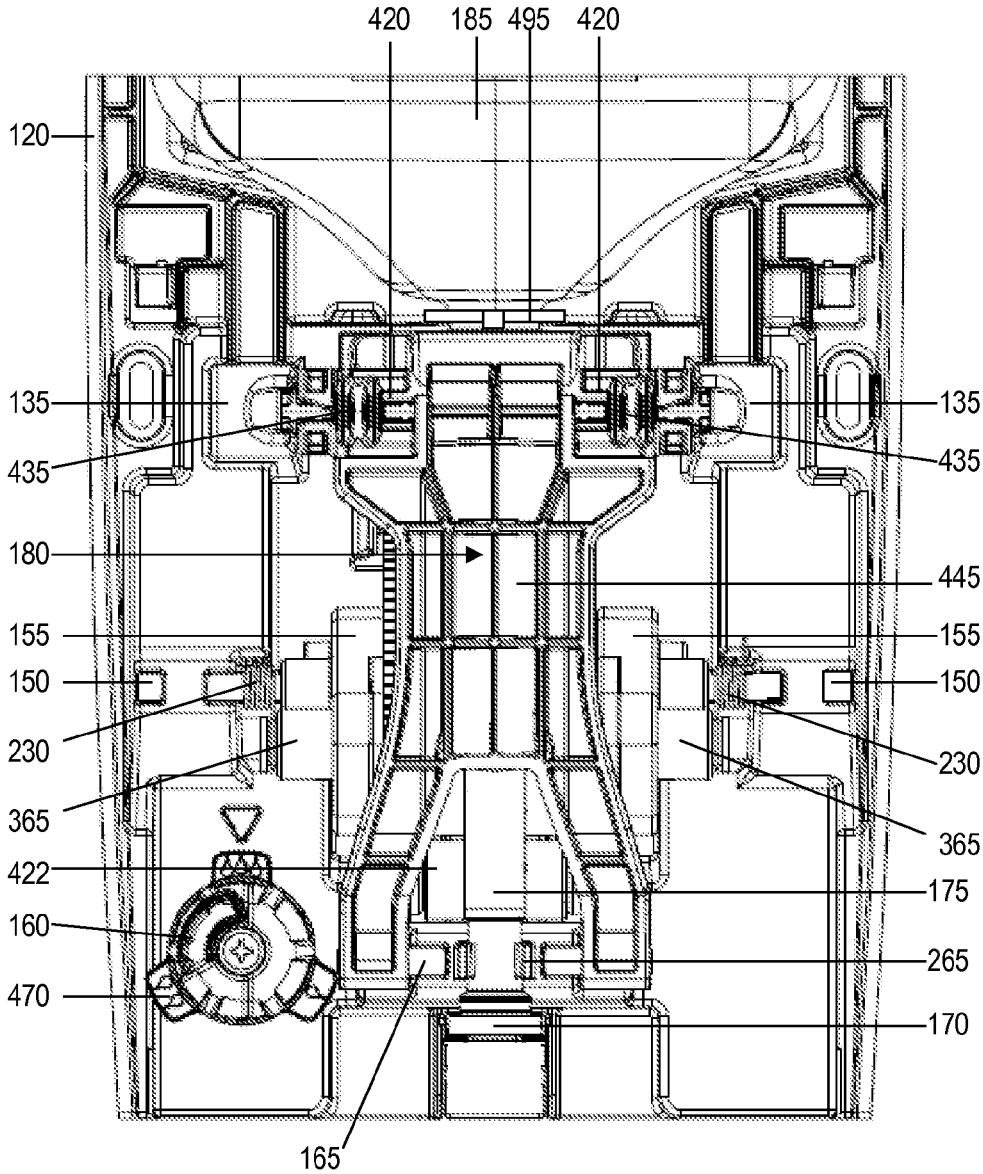
FIG. 13 is a front detail view of the saddle assembly of FIG. 11 in the liquid dispenser of FIG. 1.

As shown in FIG. 16, the adaptor nozzle 495 attaches to a reservoir outlet 490 on the reservoir 185 and transmits fluid between the reservoir 185 and the reservoir tube 175. The adaptor nozzle 495 attaches to the reservoir 185 on the bottom of the reservoir 185, as shown in FIG. 13, so that gravity assists the flow of fluid from the reservoir 185. The peristaltic action of the pump, however, does not require this and the adaptor nozzle 495 can attach to the side or top of reservoir 185 instead. In an embodiment, the reservoir outlet 490 is pierced by the adaptor nozzle 495 when the adaptor nozzle 495 is attached (e.g., screwed onto or snapped onto, etc.) so that fluid may flow into the reservoir tube 175. For example, foil or plastic may cover the reservoir outlet 490 and prevent fluid from escaping the reservoir 185 until the adaptor nozzle 495 is attached to the reservoir outlet 490. The reservoir 185 may also be adapted to seal unless the adaptor nozzle 495 is attached to the reservoir outlet 490. This allows the reservoir tube 175 and the check valve 170 to be replaced without replacing the entire reservoir 185. For example, a reservoir tube 175 with a wider diameter lumen 475 may be place on the reservoir 185 if the previous reservoir tube 175 becomes obstructed.

As shown in FIGS. 3, 13, 16, 14B, 25B, 26B, and 27B, in some embodiments the reservoir tube 175 ends in the check valve 170. The check valve 170 is a one-way pressure valve that closes until an internal pressure in the lumen 475 is exceeded. The check valve 170 is configured so that this pressure, termed the cracking pressure, opens the valve when the handle 110 is actuated but closes the valve when the handle 110 is released. In this manner, fluid is prevented from exiting the reservoir tube 175 when the handle 110 is released and in the neutral position. The check valve 170 can be any style check valve, such as an elastomeric check valve, a ball check valve, a diaphragm check valve, a swing check valve, a stop check valve, a lift check valve, a duckbill valve, etc. In an embodiment where the reservoir 185 and the reservoir tube 175 are shipped connected together, the check valve 170 also prevents air from entering the reservoir assembly 485.

Figure 12:
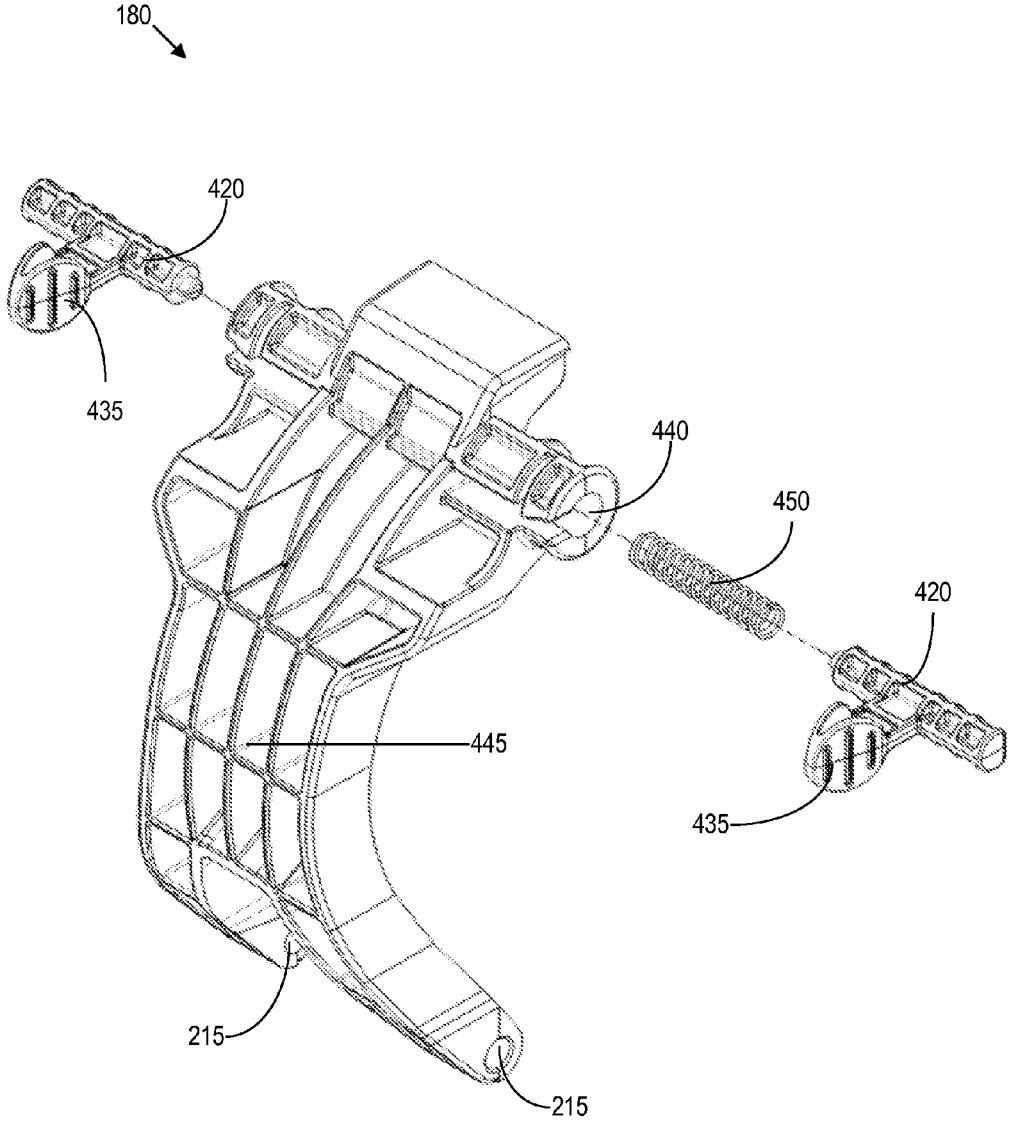
FIG. 12 is an exploded view of saddle assembly for the liquid dispenser of FIG. 1.

FIGS. 2 and 13 depict the saddle assembly 180 attached to the backing 120 at a saddle pivot 215 and at saddle latches 420 and FIGS. 3 and 12 depict an exploded view of the saddle assembly 180. A saddle body 445 between the saddle pivot 215 and the saddle latches 420 provides a surface against which the rotor assembly 140 compresses the reservoir tube 175. In an embodiment, the saddle assembly 180 is injection molded rigid plastic and provides a curved, solid surface generally adjacent to a portion of the rotor assembly 140. The saddle pivot 215 attaches to the backing at a saddle axle 165, which extends through the saddle pivot 215 and secures the saddle body 445 to two saddle support arms 260 that extend substantially perpendicularly from the backing 120. In an embodiment best seen in FIGS. 3 and 4, the saddle axle 165 extends through a saddle axle bearing 225 at the end of the saddle support arms 260, forming the saddle pivot 215. A single saddle support arm 260 may also be used (not shown), wherein the single saddle support arm 260 attaches to the saddle body 445 along the entire length of the saddle axle 165. In this embodiment, an opening 422 in the saddle body 445 allows the reservoir tube 175 to extend through the saddle assembly 180. In a still further embodiment (not shown), the saddle assembly 180 is directly connected to the backing 120 at the saddle pivot 215.

Figure 14A:
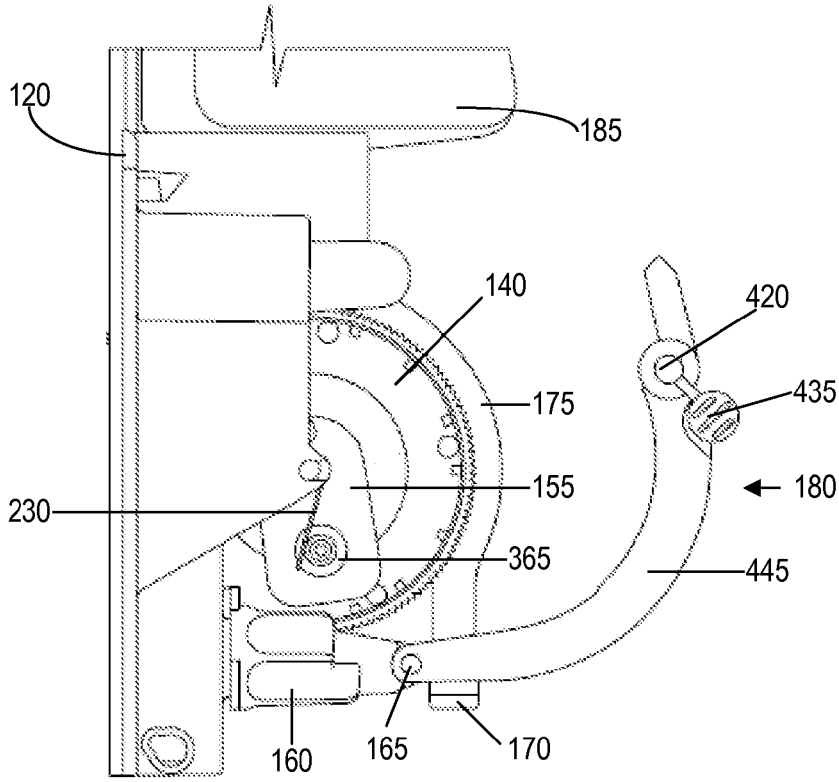
FIG. 14A is a side view of the saddle assembly of FIG. 11 with the saddle assembly rotated away from the rotor assembly.
Figure 14B:
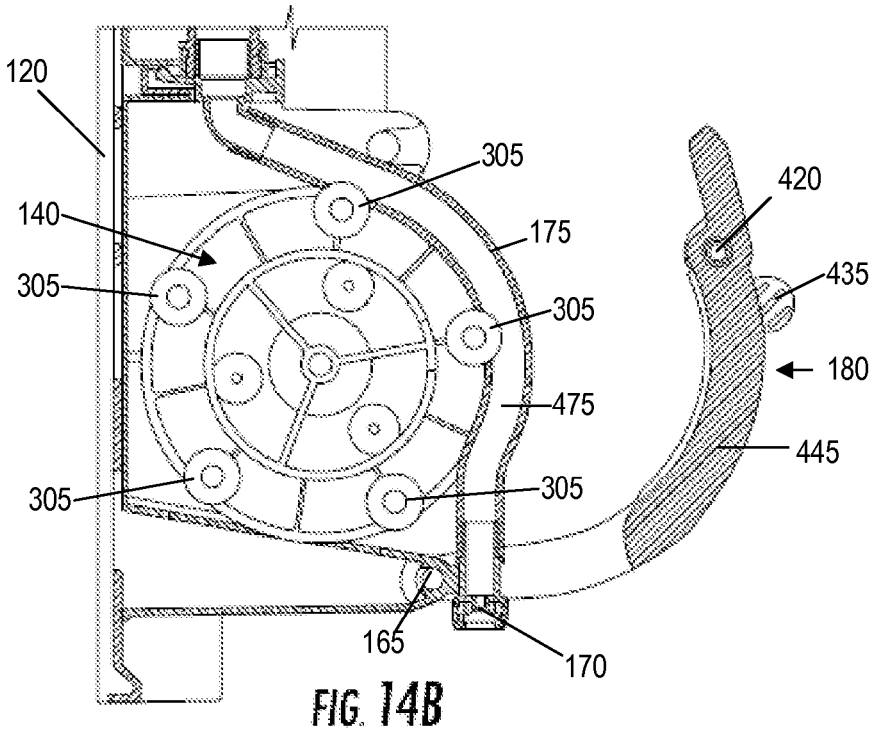
FIG. 14B is a cutaway side view of the saddle assembly of FIG. 11 with the saddle assembly rotated away from the rotor assembly.

FIGS. 2 and 13 also show the saddle latches 420 removably attached to the backing 120 at saddle brackets 135 positioned between the reservoir 185 and the saddle axle 165. The saddle brackets 135 are configured to receive the retractable saddle latches 420. As shown in the exploded view in FIG. 12, each saddle latch 420 comprises a saddle shaft 440, at least one saddle spring 450, and at least one saddle latch grip 435. The saddle latches 420 removably attach a portion of the saddle body 445 to the backing 120. In an embodiment, the saddle latch grips 435 are used to move the saddle latches 420 toward the center of the saddle body 445 against the bias of saddle spring 450 and release the backing 120. When the saddle latches 420 have released the backing 120, the saddle body 445 may swing away from the backing 120 at the saddle axle 165, as shown in FIGS. 14A and 14B. In some embodiments, the saddle assembly 180 includes a saddle latch 420 on opposing sides of the saddle assembly 180. The saddle assembly 180 may also include a saddle latch 420 on only one side of the saddle assembly 180. A buckle, a removable axle, or clips may also be used to removably attach a portion of the saddle assembly 180 to the backing 120.

Figure 25A:
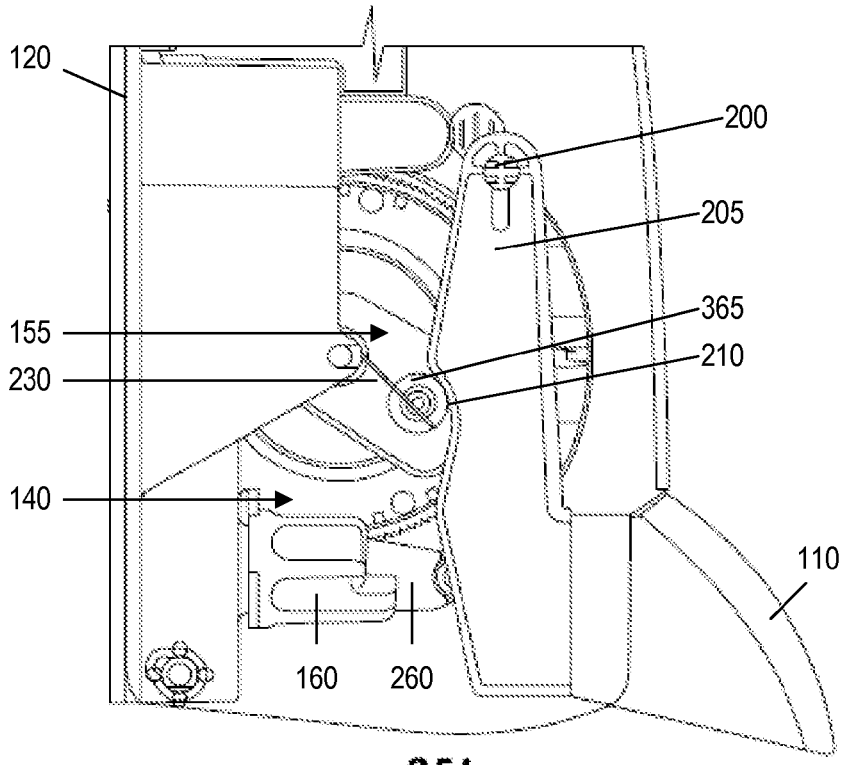
FIG. 25A is a side view of the liquid dispenser of FIG. 1 before the handle is actuated.
Figure 25B:
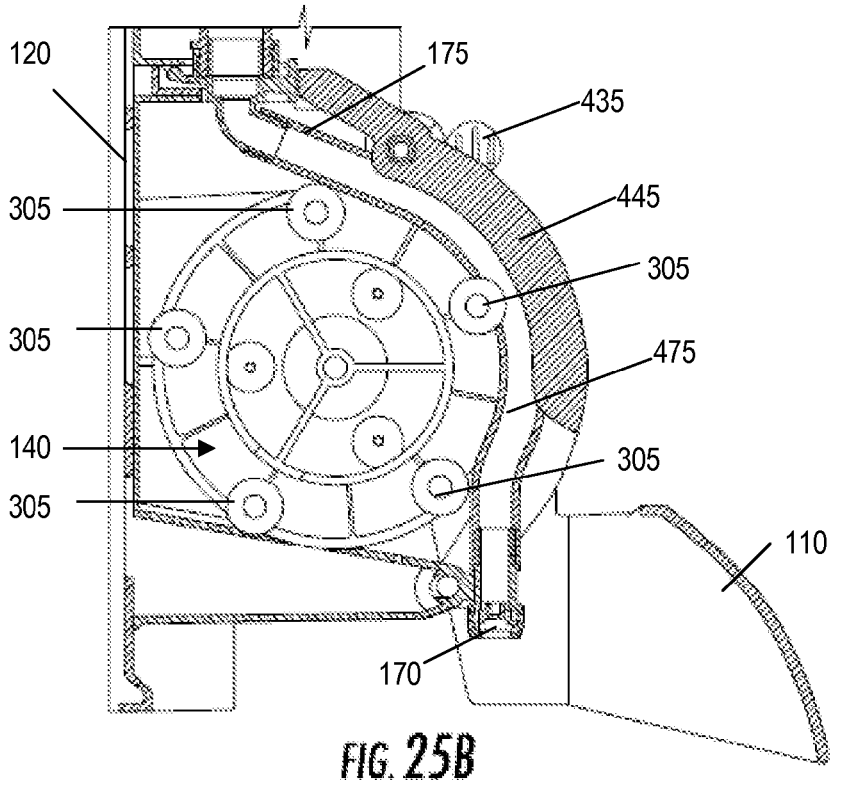
FIG. 25B is a cutaway side view of the liquid dispenser of FIG. 1 before the handle is actuated.

FIG. 25B shows that the saddle body 445 forms the portion of the saddle assembly 180 against which the reservoir tube 175 is compressed when the handle 110 is actuated. In an embodiment shown in FIG. 15, a concave surface 480 on the saddle body 445 contacts the reservoir tube 175 so that the reservoir tube 175 is maintained in the center of saddle body 445 when the rollers 305 compress the reservoir tube 175. The concave surface 480 is concave in a direction generally perpendicular to the reservoir tube 175 and has a low degree of curvature. The concave surface 480, however, may also have a high degree of curvature, may have an apex, or may have a depression running down the center of the saddle body 445 into which the reservoir tube 175 fits. Still further, the saddle body 445 may have no curvature in the direction generally perpendicular to the reservoir tube 175.

FIGS. 14A and 14B depict the attachment devices when the saddle assembly 180 is pivoted away from the rotor assembly 140 at the saddle axle 165. When the saddle assembly 180 is remote from the rotor assembly 140, the reservoir 185 and reservoir tube 175 can be removed from the backing 120 and replaced. When the saddle latches 420 are squeezed towards the center of the saddle body 445, the saddle spring 450 (shown in FIG. 12) compresses and the user is able to the pivot the saddle body 445 away from the reservoir tube 175, as shown in FIG. 14A. The cutaway view of FIG. 14B shows the reservoir tube 175 adjacent to the rollers 305. When the saddle body 445 is pivoted away from the rotor assembly 140, the lumen 475 of the reservoir tube 175 is not compressed. The user can pull the reservoir tube 175 away from the rotor assembly 140, detach the reservoir 185 from the backing 120, and replace the reservoir assembly 485.

FIGS. 3 and 4 depict the saddle assembly 180 completely detached from the backing 120. The saddle axle 165, shown in FIG. 4, has been removed from the saddle axle bearing 225. The saddle pivots 215 are released from the backing 120. The saddle latches 420 are detached from the saddle brackets 135 on the backing 120, and the saddle assembly 180 is pulled away from the backing 120.

FIGS. 2 and 3 depict the rotor assembly 140 and the ratchet assemblies 155 as assembled with the backing 120. The individual elements of the rotor assembly 140, such as rollers 305, drive gears 330, and backlash gears 300, will be discussed later with respect to FIGS. 5-8. The individual elements of the ratchet assemblies 155, such as a ratchet housing 400, ratchet roller 365, and ratchet shaft 395, will be discussed later with respect to FIGS. 9-11. The rotor assembly 140 and the ratchet assemblies 155 attach to the backing 120 using a rotor axle 150 that extends into a rotor axle bearing 145 on either side of the rotor assembly 140. In an exemplary embodiment, a ratchet assembly 155 is included on both sides of the rotor assembly 140, as seen best in FIG. 13. In an embodiment best seen in FIG. 11, a rotor spring 230 is positioned on the rotor axle 150 and biases the ratchet assemblies 155 away from the backing 120. The rotor axle bearing 145 can be built into or attached to the backing 120. The rotor axle 150 is secured against rotation in the rotor axle bearing 145, such as by pressure fit, adhesive, or screws, and is oriented along an axis that is substantially perpendicular to the direction of fluid flow. When the rotor assembly 140 rotates on the rotor axle 150, fluid is advanced in a forward direction through the reservoir tube 175 in a manner similar to a peristaltic pump. As will be discussed in greater detail later with respect to FIGS. 25A-27B, when the handle 110 is actuated the ratchet assemblies 155 cause the rotor assembly 140 to rotate, which in turn causes liquid to be dispensed from the reservoir 185. When the handle 110 is released, the rotor spring 230 biases the ratchet assemblies 155 and handle 110 back to a neutral position.

FIGS. 3 and 4 depict the rotor assembly 140 and the ratchet assemblies 155 detached from the backing 120. The rotor axle 150 is removed from the rotor axle bearings 145 and then the rotor axle 150 is removed from the ratchet assemblies 155 and the rotor spring 230. The rotor axle 150 can also be removed from the rotor assembly 140 (not shown). In an embodiment, the rotor assembly 140 is removed from the backing with the individual constituent parts, such as the rollers 305, the drive gear 330, and the backlash gear 300, operatively connected to one another. Similarly, when the ratchet shaft 395 is removed from the rotor axle 150, the individual constituent parts of the ratchet assembly 155, such as the ratchet housing 400 and the ratchet roller 365, remain operatively connected to one another. If the rotor assembly 140 or one of the ratchet assemblies 155 is being replaced, the self-contained assemblies can be removed and replaced without replacing the entire liquid dispenser 100.

Figure 5:
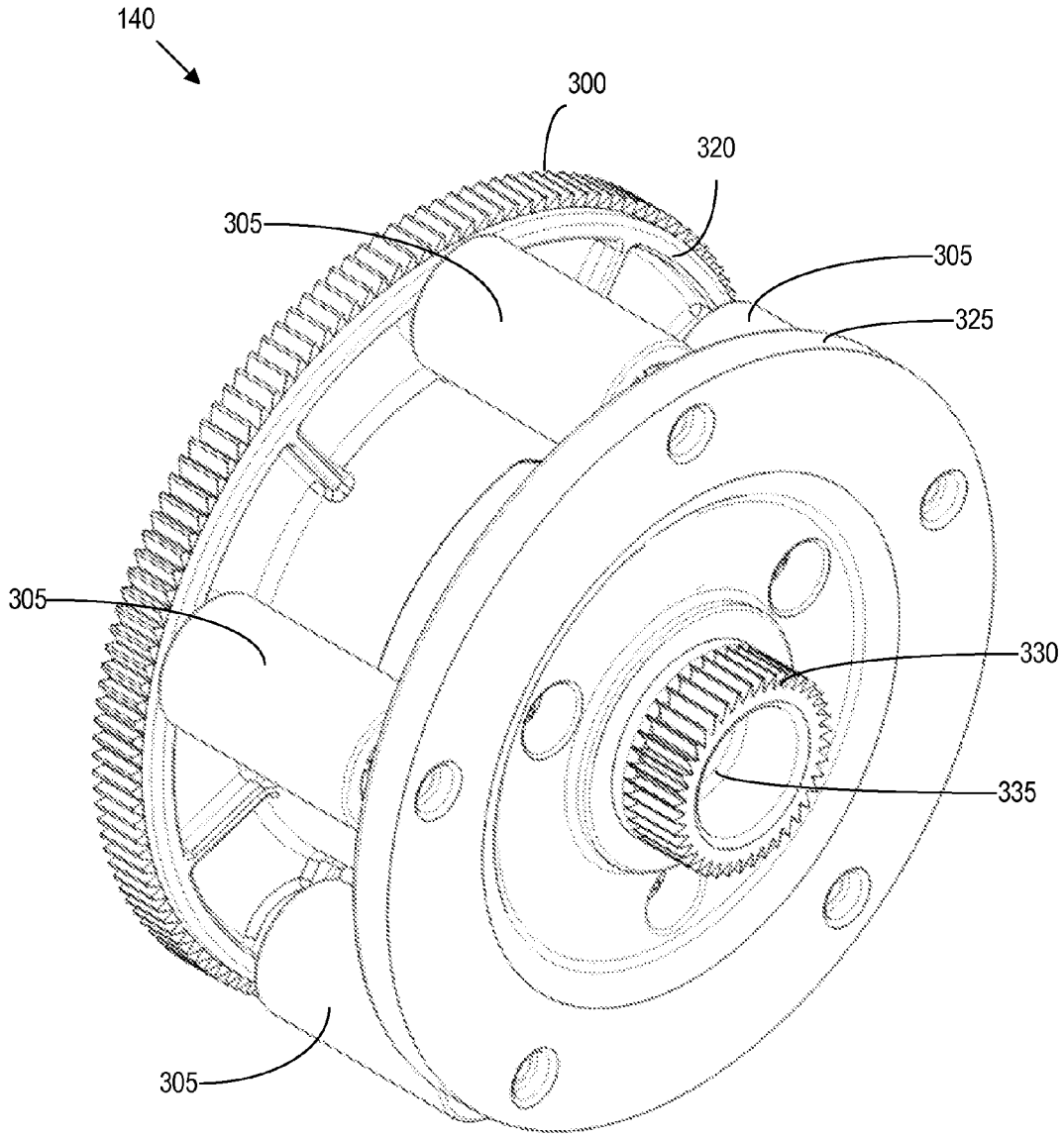
FIG. 5 is a perspective view of an embodiment of the rotor assembly for the liquid dispenser of FIG. 1.
Figure 6A:
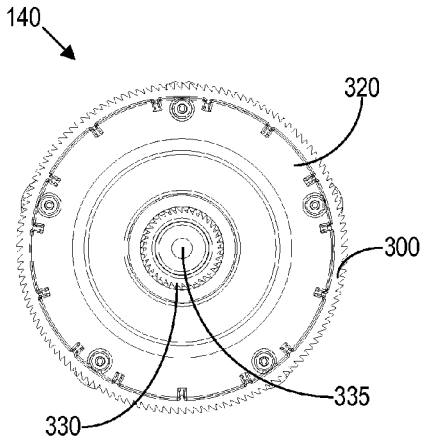
FIG. 6A is a left side view of the rotor assembly of FIG. 5.
Figure 6B:
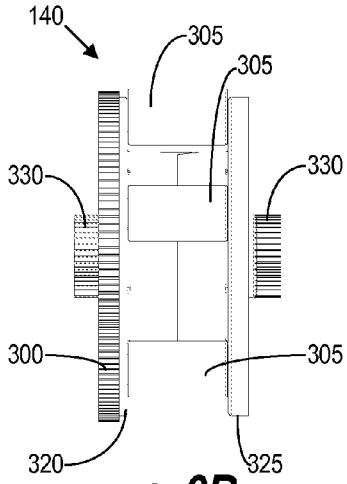
FIG. 6B is a front view of the rotor assembly of FIG. 5.
Figure 6C:
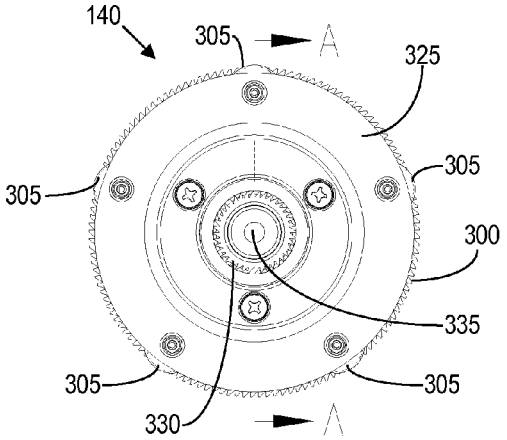
FIG. 6C is a right side view of the rotor assembly of FIG. 5.
Figure 6D:
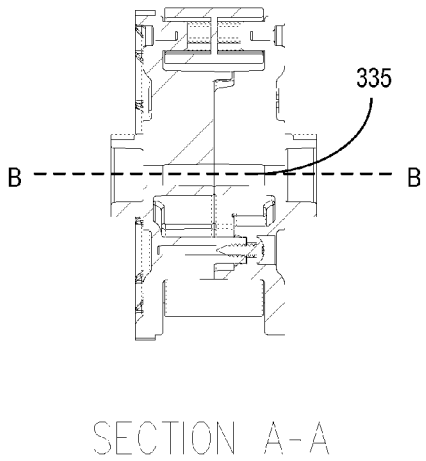
FIG. 6D is a section view of the rotor assembly of FIG. 5.

Turning now to FIGS. 5-8, views of embodiments of the rotor assembly 140 are provided. FIG. 5 provides a perspective view of the rotor assembly 140 according to one embodiment. The rotor assembly 140 comprises a left side 320, shown in FIG. 6A, and a right side 325, shown in FIG. 6C. The rotor sides are injection molded. Rotor screws attach the left side 320 and the right side 325 of the rotor assembly 140 to one another. Compression elements 305 are positioned between the left side 320 and the right side 325 of the rotor assembly 140. The compression elements 305 slide along and compress the reservoir tube 175 when the rotor assembly 140 rotates, thereby causing fluid to advance through the reservoir tube 175. The compression elements 305 are equally spaced along a circle centered on the axis of rotation at the rotor bearing 335 and equally spaced on the periphery of the rotor assembly 140. In an embodiment, the compression elements 305 are spaced on the periphery so that at least one compression element 305 is always compressing the reservoir tube 175. The rotor assembly 140 is designed so that an equal angle of rotation of the rotor assembly 140 results in an equal amount of liquid dispensed from the liquid dispenser 100. The rotor assembly 140 rotates a specific angle of rotation depending on the distance that the handle 110 is actuated. Therefore, actuation of the handle 110 a specific distance will cause the rotor assembly 140 to rotate through a predefined angle of rotation. Correspondingly, the predefined angle of rotation will disperse a defined amount of liquid.

Figure 15:
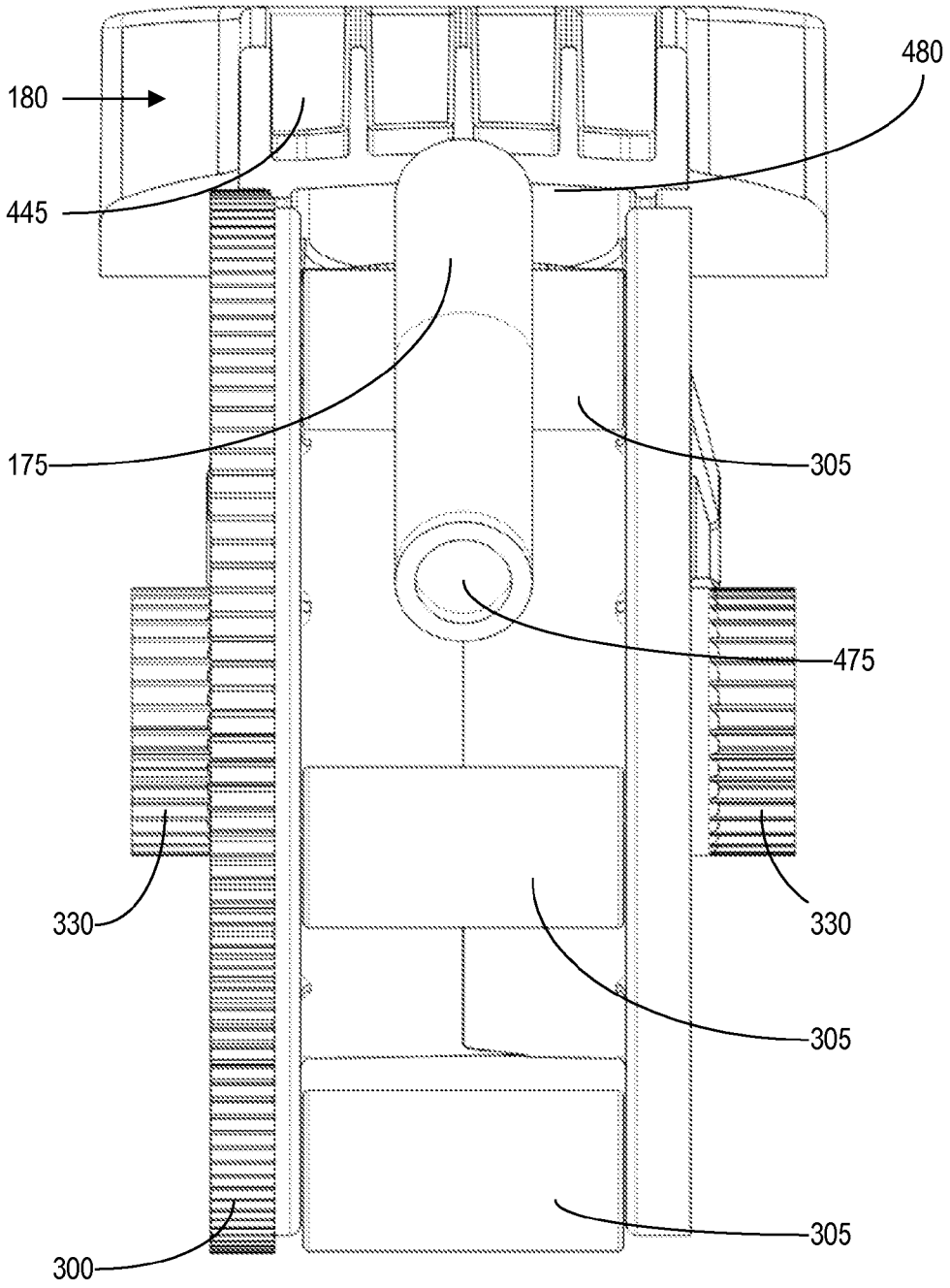
FIG. 15 is a front detail view of the rotor assembly and saddle assembly of the liquid dispenser of FIG. 1.

In an exemplary embodiment shown in FIGS. 5, 6B, 7, and 8, the compression elements 305 include a plurality of rollers 305 between the left side 320 and the right side 325 of the rotor assembly 140. The rollers 305 can be injection molded plastic, extruded plastic, or metal. The rollers 305 are generally cylindrical and spaced a fixed distance from the rotor bearing 335. The rollers 305 may also be equally spaced on the periphery of the rotor assembly 140. In an exemplary embodiment, the rotor assembly 140 comprises five rollers 305. It should be understood that any number of rollers 305 may be used based on the size of the rotor assembly 140 and the distance between the rollers 305. The rollers 305 are configured to rotate on axes that are substantially parallel to the rotation of the rotor assembly 140 around the rotor axle 150, as shown in FIG. 3. The axes are also substantially perpendicular to the orientation of the reservoir tube 175, as shown in FIG. 15. In another embodiment (not shown), the compression elements 305 are shoes instead of or in addition to rollers 305. The shoes are configured to compress the reservoir tube 175 without rotating as the rotor assembly 140 rotates and thereby advance liquid through the reservoir tube 175.

Figure 7:
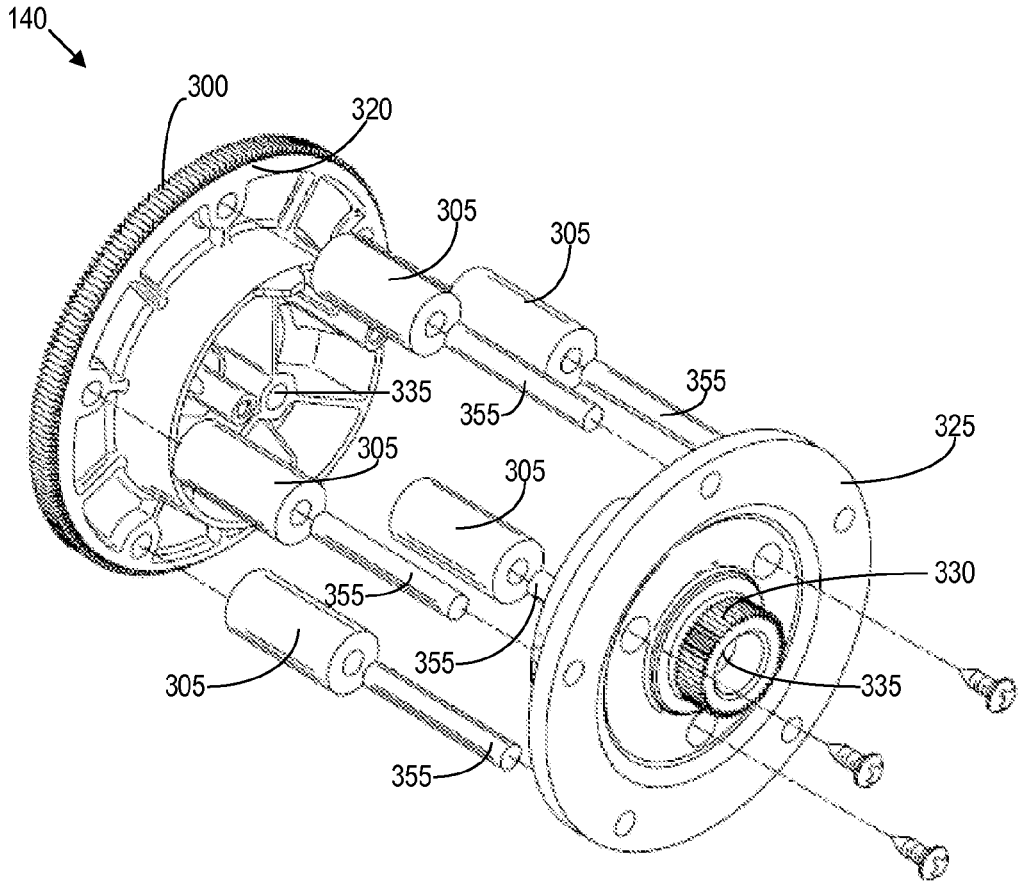
FIG. 7 is an exploded view of the rotor assembly of FIG. 5.
Figure 8:
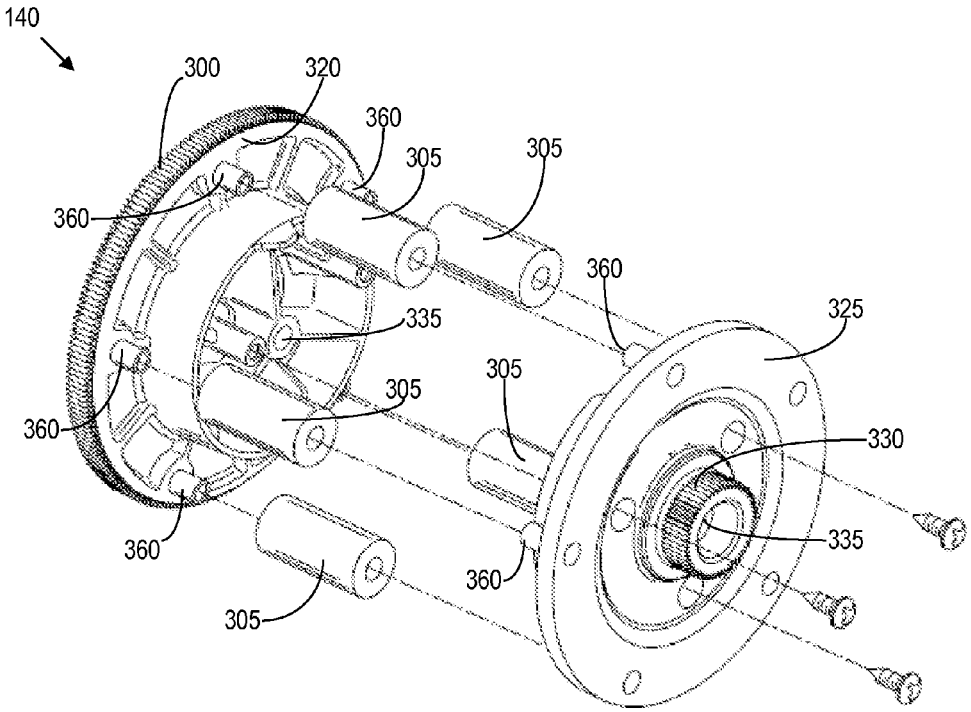
FIG. 8 is an exploded view of a second embodiment of the rotor assembly for the liquid dispenser of FIG. 1.

In an embodiment shown in FIG. 7, a roller axle 355 extends between the sides of the rotor assembly 140 and allows the rollers 305 to spin. The roller axles 355 are made of steel or other rigid material that allows the rollers 305 to rotate around them. In another embodiment shown in FIG. 8, rollers 305 mount onto roller nubs 360 on the left side 320 and the right side 325 of the rotor assembly 140. The roller nubs 360 are manufactured from a material that has a low coefficient of friction with the roller 305 material. For example, the roller nubs 360 may be manufactured from nylon and the rollers 305 may be manufactured from acetal. The rollers 305 mount onto the roller nubs 360 and rotate around them. The rollers may rotate in other ways as well, such as by being attached to a bushing or bearing on one or both sides of the rotor assembly 140 (not shown).

Figure 28:
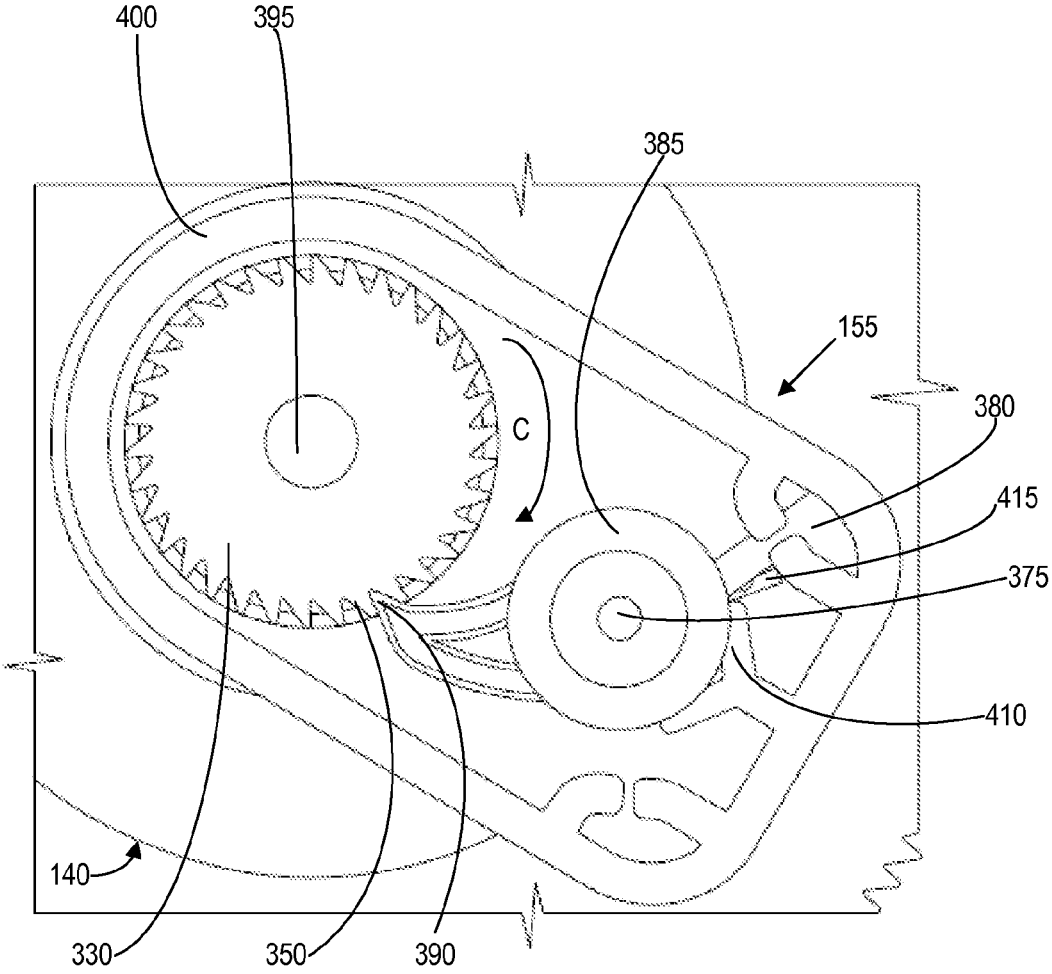
FIG. 28 is a detail view of the ratchet assembly engaging the rotor assembly in the liquid dispenser of FIG. 1.
Figure 29:
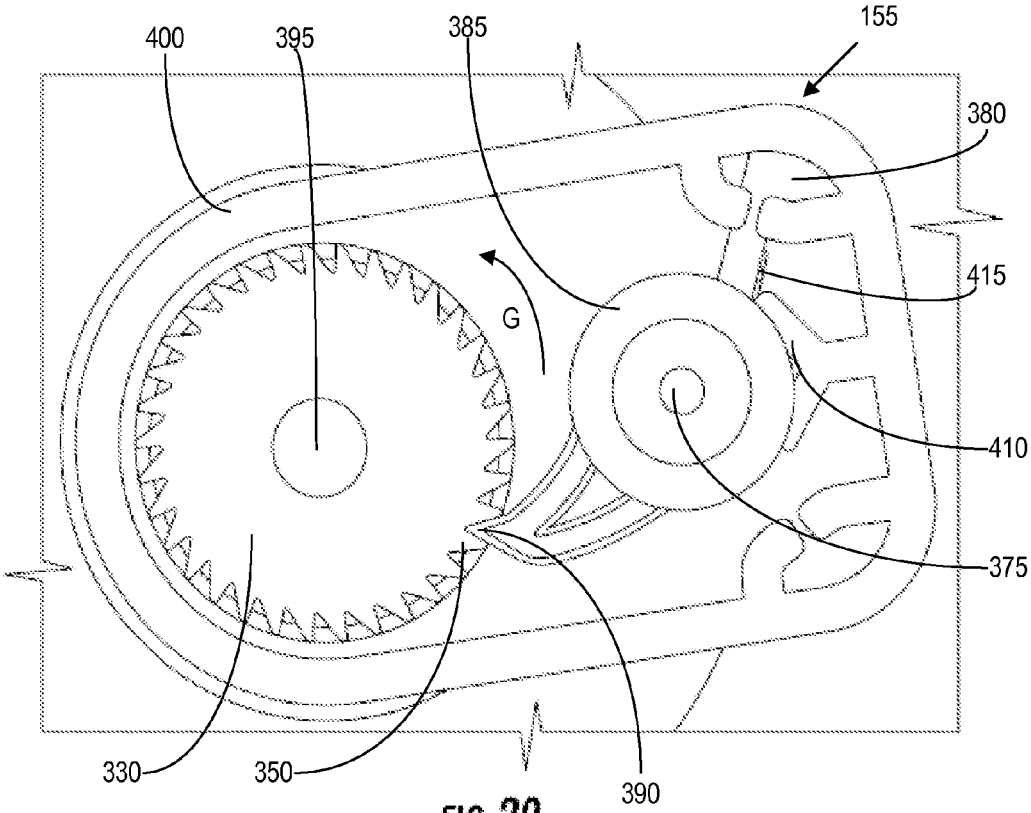
FIG. 29 is a detail view of the ratchet assembly disengaging the rotor assembly in the liquid dispenser of FIG. 1.

As shown in FIGS. 5, 6B, 7, and 8, the rotor assembly 140 also comprises a drive gear 330 on at least one of the rotor assembly sides 320, 325. As will be discussed with respect to FIGS. 25-29, the drive gear 330 engages the ratchet assembly 155 and causes the rotor assembly 140 to rotate. A rotor bearing 335 defines an opening through the rotor assembly 140 that receives the rotor axle 150 and allows the rotor assembly 140 to rotate about central axis B-B. As shown in a detail view in FIG. 28, the drive gear 330 includes drive gear teeth 350 that engage with a pawl 385 on the ratchet assembly 155. The drive gear teeth 350 are angled so that the pawl 385 engages the teeth 350 when rotating in a first direction, as shown in FIG. 28, but slips over the teeth 350 when rotating in a second direction, as shown in FIG. 29. The drive gear teeth 350 may also extend radially from the center of the rotor assembly 140. The drive gear 330 may have any diameter and changing the diameter of the drive gear 330 will change the amount of liquid dispensed when the handle 110 is actuated.

Figure 30:
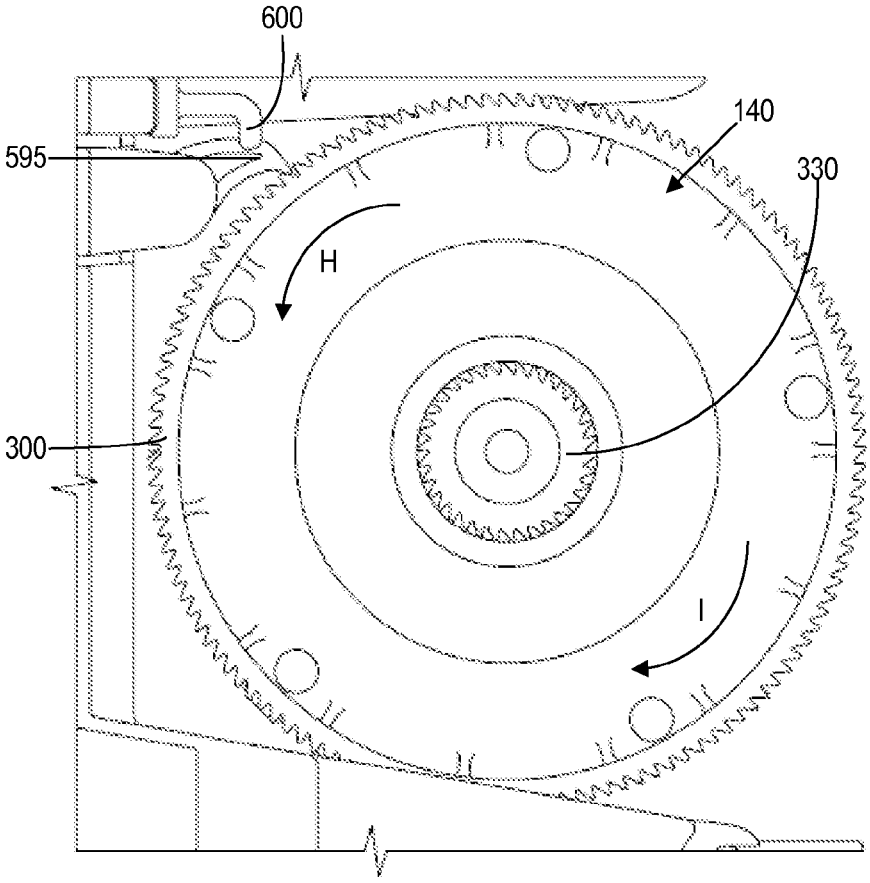
FIG. 30 is a detail view of the backlash ratchet engaging the rotor assembly in the liquid dispenser of FIG. 1.

In an embodiment shown in FIG. 30, the rotor assembly 140 also comprises a backlash gear 300 configured to engage a backlash ratchet 595. The backlash gear 300 and the backlash ratchet 595 restrict the rotor assembly 140 from rotating in a reverse direction indicated by arrow H, i.e., the reverse direction from the direction that dispenses liquid from the liquid dispenser 100. As shown in FIGS. 5, 6B, 7, 8, 15, and 30, the backlash gear 300 has a greater diameter than the drive gear 330. The backlash gear 300 is mounted to rotate in the forward direction with the drive gear 330 as indicated by arrow I shown in FIG. 30, and may have a larger diameter than the drive gear 330, a smaller diameter than the drive gear 330, or the same diameter of the drive gear 330.

Figure 9:
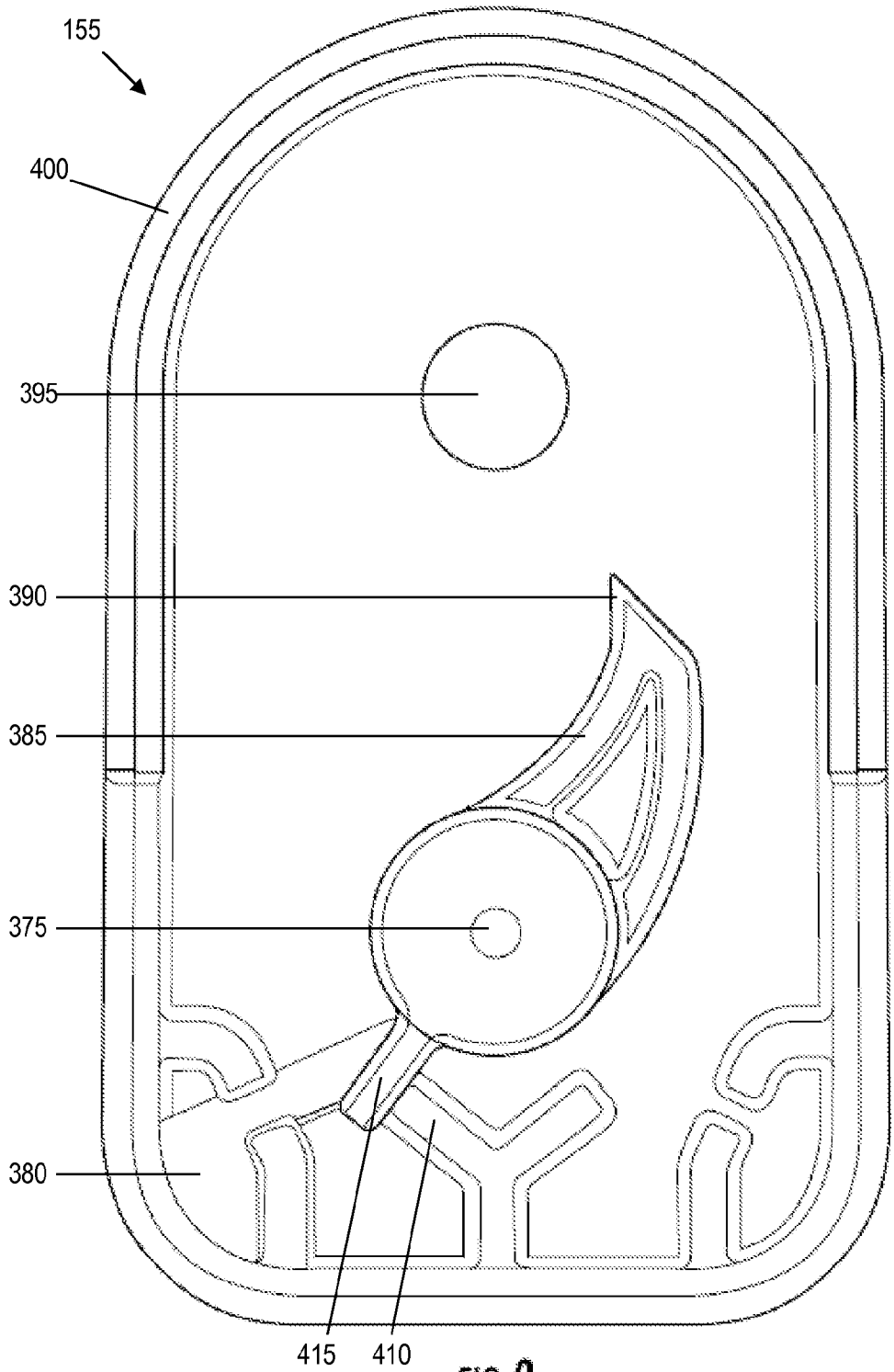
FIG. 9 is a front view of the ratchet assembly for the liquid dispenser of FIG. 1.
Figure 10:
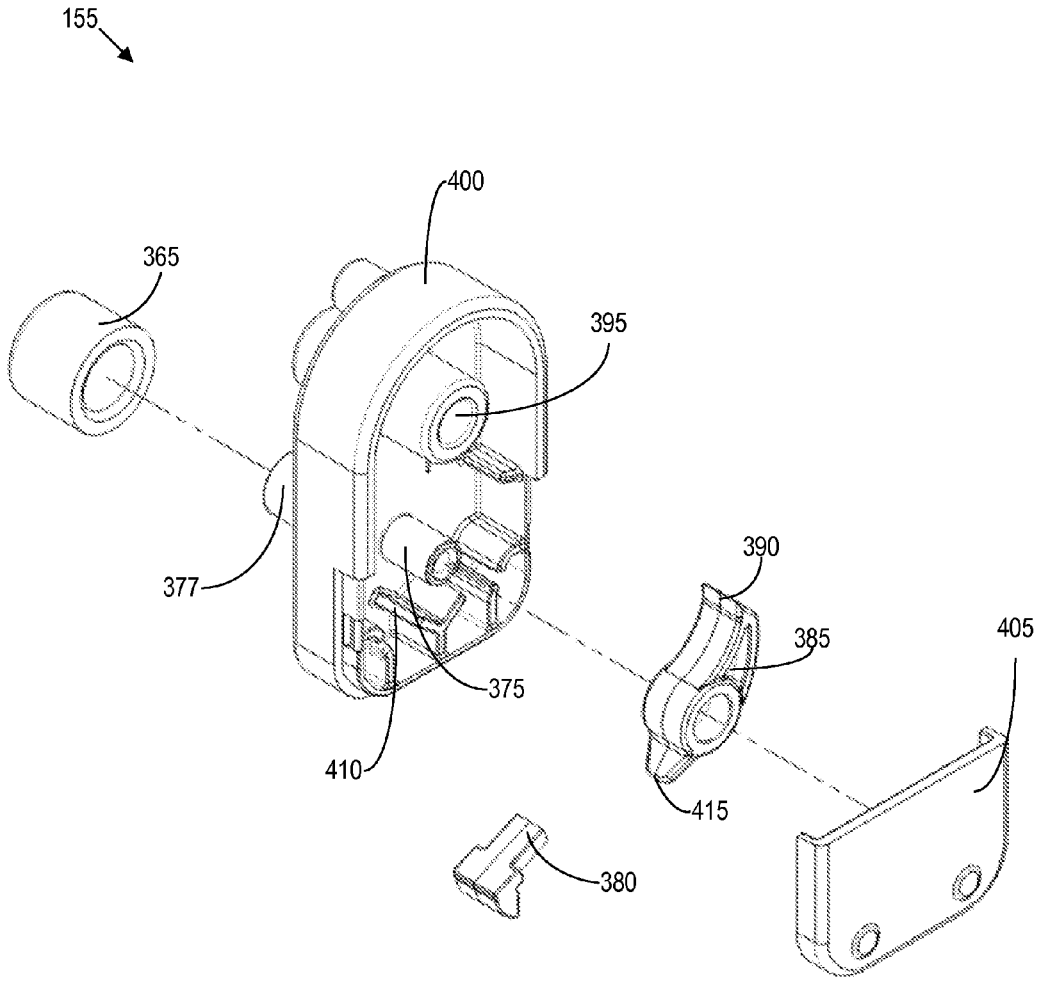
FIG. 10 is an exploded view of the ratchet assembly of FIG. 9.
Figure 11:
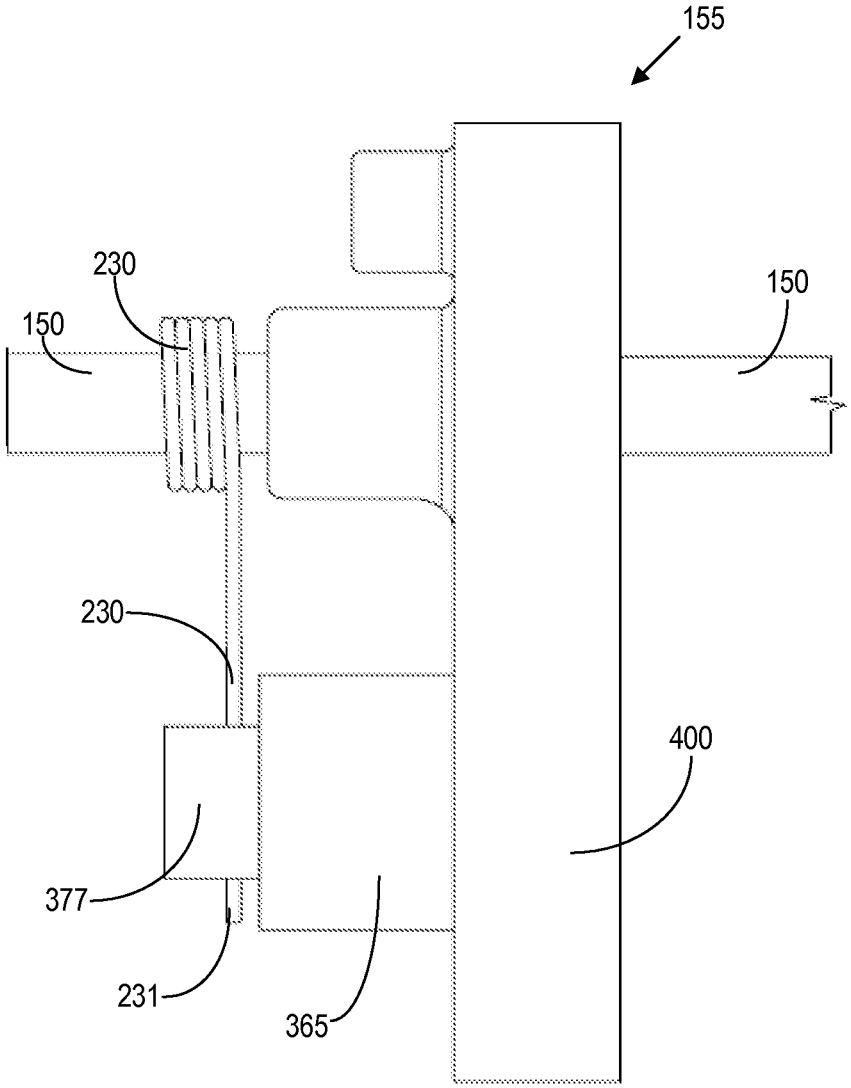
FIG. 11 is a detail view of the ratchet assembly of FIG. 9 and the rotor spring.
Figure 26A:
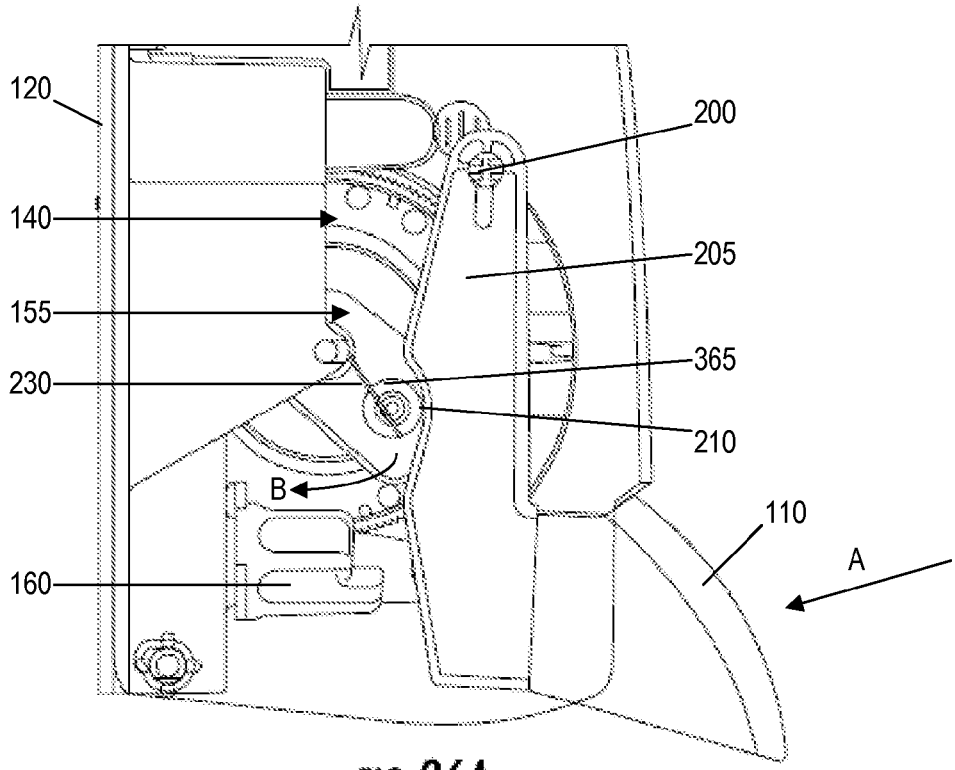
FIG. 26A is a side view of the liquid dispenser of FIG. 1 when the handle is partially actuated.

Turning now to FIGS. 9, 10, and 11, detail views of the ratchet assemblies 155 included in the liquid dispenser 100 are provided. The ratchet assemblies 155 are mirror images of one another and therefore only a single ratchet assembly 155 is depicted in the detail views for explanation purposes. The ratchet assemblies 155 comprise a ratchet housing 400 defining a ratchet shaft 395 and enclosing the pawl 385 having a pawl tip 390 and a ratchet spring 380. The ratchet shaft 395 allows the ratchet assembly 155 to rotate around the rotor axle 150, as shown in FIG. 11. FIG. 10 shows that a ratchet cover 405 encloses a portion of the pawl 385 in the ratchet housing 400. The pawl 385 rotates around a pawl pin 375 that extends from the ratchet housing 400. The ratchet housing 400 also includes a ratchet post 377 that protrudes from the housing in the opposite direction as the pawl pin 375 and is coaxial with the pawl pin 375. A ratchet roller 365 is mounted on the ratchet post 377 and is configured to rotate on the ratchet post 377. The ratchet roller 365 engages the handle arms 205 during handle 110 actuation in the direction shown by arrow A, as shown in FIG. 26A. The pawl tip 390 is configured to engage the drive gear teeth 350, as shown in FIG. 28. In an embodiment, the pawl tip 390 is angular. The pawl tip 390 may also be squared off or rounded and configured to removably mate with the drive gear teeth 350.

FIG. 11 provides a detail view of the rotor spring 230 biasing the ratchet assembly 155, as also seen in FIGS. 13, 14A, and 25A-27A. In FIG. 11, the ratchet assembly 155 and the rotor spring 230 are mounted on the rotor axle 150. As discussed previously, the ratchet shaft 395 (not shown in FIG. 11) defined by the ratchet housing 400 receives the rotor axle and allows the ratchet housing 400 to rotate around the rotor axle 150. A first end (not shown) of the rotor spring 230 is secured against movement by attachment to the backing 120. For example, the first end of the rotor spring 230 may be inserted into an opening in the backing 120, attached to the backing 120 by a screw or adhesive, or otherwise secured against movement with respect to the backing 120. A distal end 231 of the rotor spring 230 is then bent until it is contacting the ratchet post 377. The rotor spring 230 biases the ratchet roller 365 away from the backing 120 and toward handle 110, as shown in FIG. 25A. When the user actuates the handle 110, the handle arms 205 contact the ratchet roller 365 and rotate the ratchet housing 400 around the rotor axle 150. This causes the rotor spring 230 to compress further so that when the handle 110 is released, the ratchet assembly 155 and handle 110 return to the neutral position.

FIG. 28 depicts the ratchet assembly 155 engaging the drive gear 330 when the handle 110 (not shown in FIG. 28) is actuated. The pawl tip 390 engages the drive gear teeth 350 and causes the rotor assembly 140 to rotate in the direction indicated by arrow C shown in FIG. 28. FIG. 29 depicts the ratchet assembly disengaging from the drive gear 330 when the handle 110 (not shown in FIG. 29) is released. When the handle 110 is released, the pawl tip 390 disengages from the drive gear teeth 350 and slips over the teeth 350 as the rotor spring 230 returns the ratchet assemblies 155 to the neutral position. The position of the pawl 385 varies to allow the pawl tip 390 to slide over the drive gear teeth 350, in the direction indicated by arrow G in FIG. 29. The ratchet spring 380 is an elastomeric spring and allows a degree of rotation in the pawl 385 relative to the pawl pin 375. The ratchet spring 380 may also be a torsion spring, a leaf spring, or a silicone spring. In an embodiment, a pawl extension 415 is positioned between a pawl stop 410 and the ratchet spring 380. In another embodiment, the pawl 385 does not include a pawl extension 415. Instead, the ratchet spring 380 applies a continuous load to the pawl 385 and biases the pawl tip 390 towards the drive gear teeth 350. When the ratchet assembly 155 is advanced, the pawl stop 410 prevents the pawl 385 from rotating after engaging the drive gear teeth 350. When the ratchet assembly 155 is returning to the neutral position the ratchet spring 380 flexes and allows the pawl tip 390 to slip over the drive gear teeth 350. Other methods of allowing a degree of rotation in the pawl 385 are possible, such as using coil springs that bias the pawl tip 390 towards the gear teeth but allows the pawl tip 390 to slip over the teeth in the reverse direction.

Figure 17:
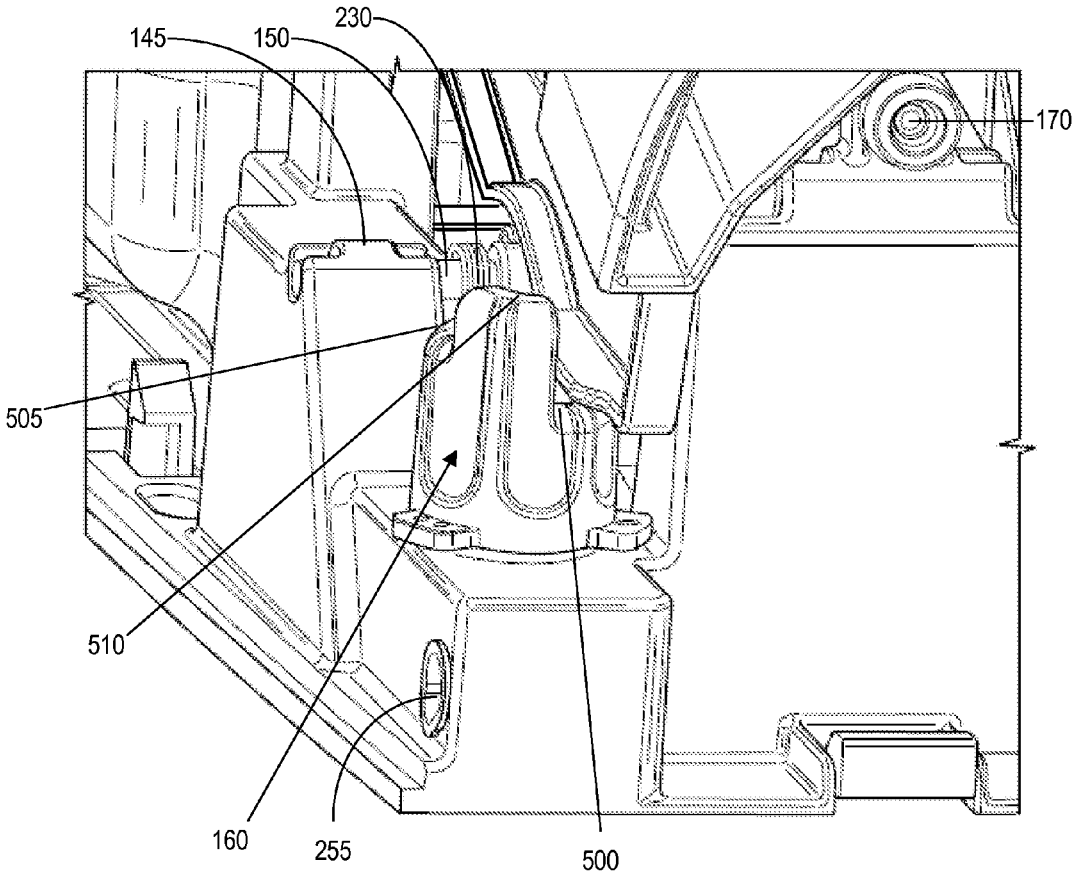
FIG. 17 is perspective view of a first embodiment of a dose control assembly for the liquid dispenser of FIG. 1.
Figure 19:
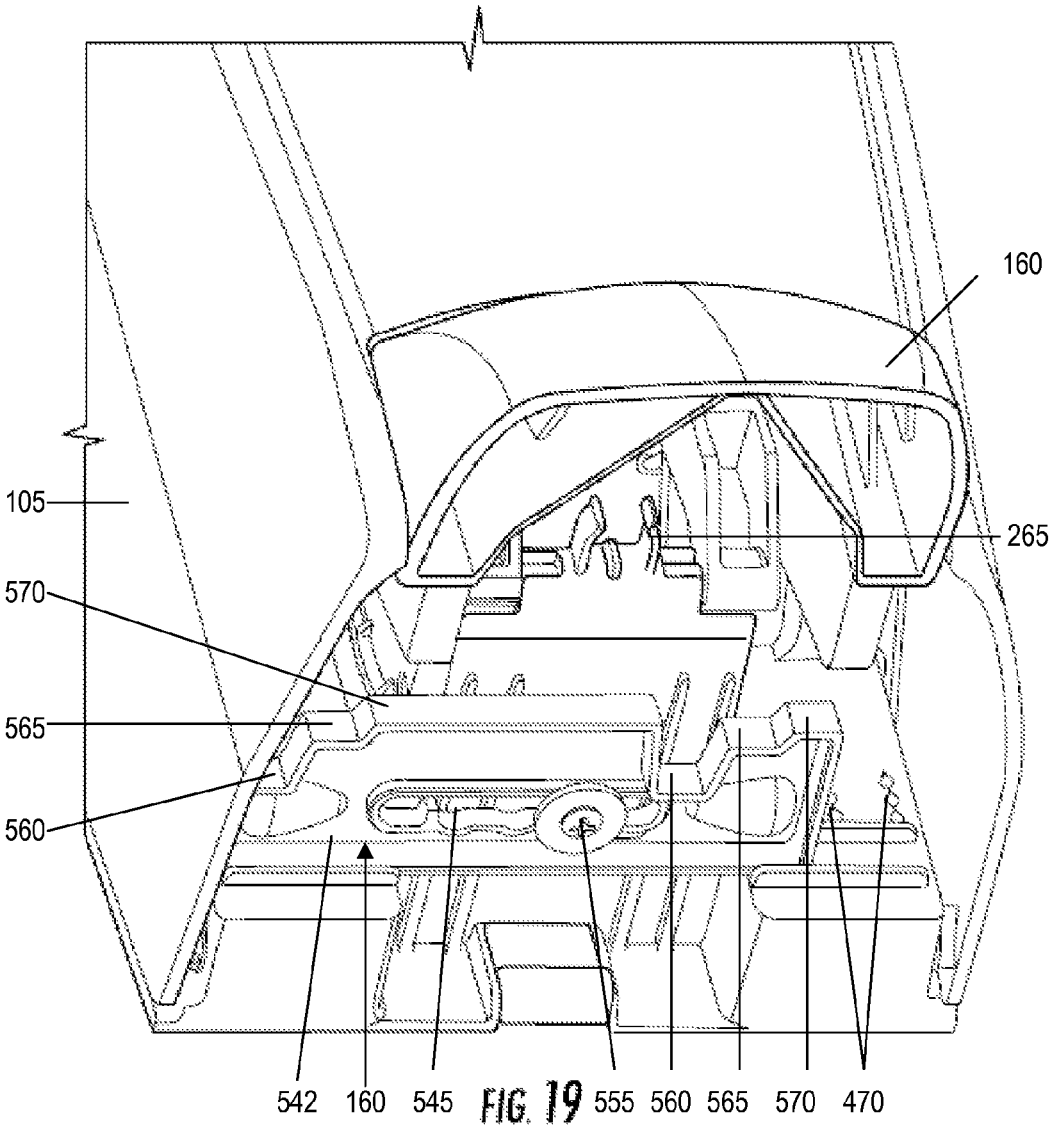
FIG. 19 is a perspective view of a second embodiment of a dose control assembly for the liquid dispenser of FIG. 1.
Figure 20A:
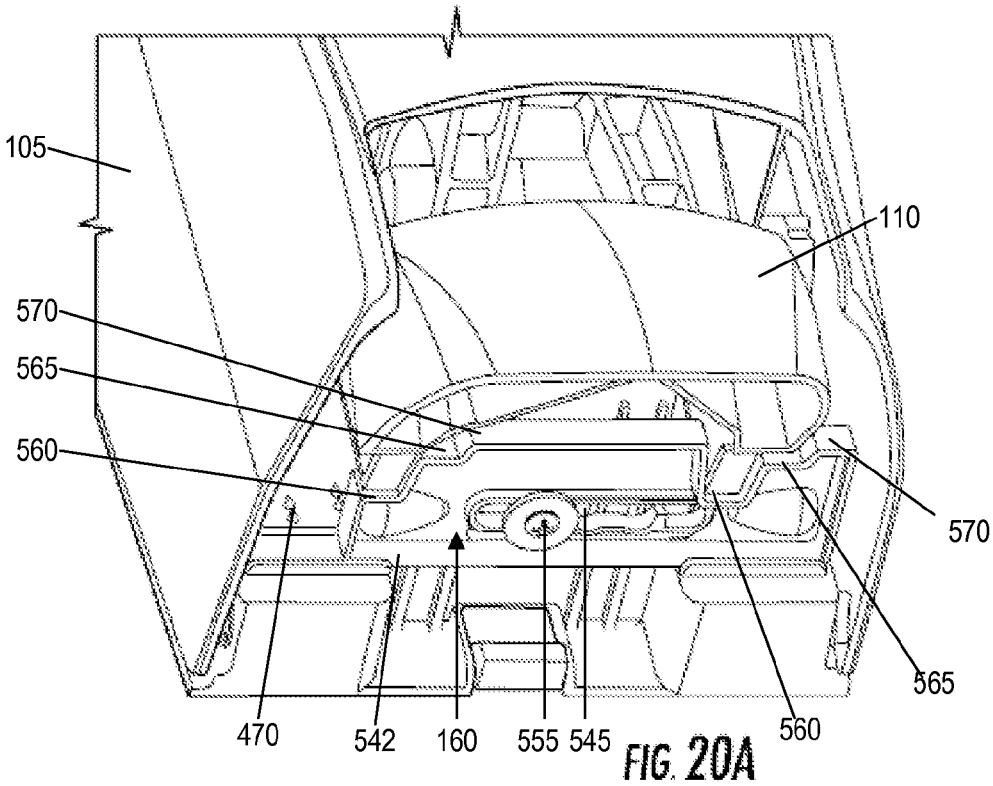
FIG. 20A is a perspective view of the dose control assembly of FIG. 19 configured for high output.
Figure 20B:
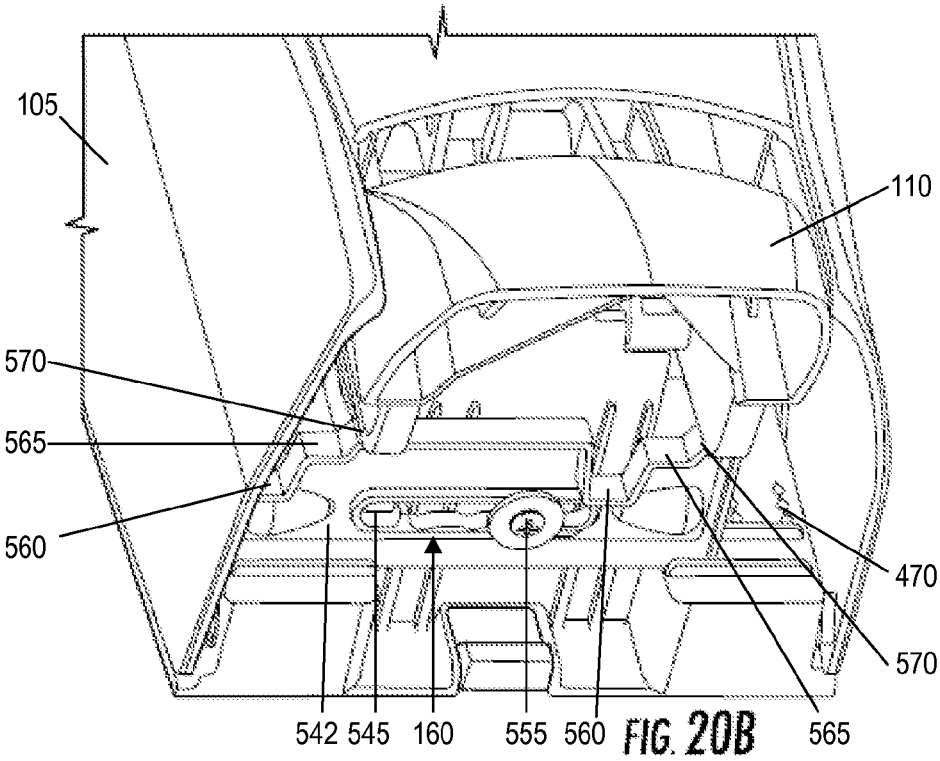
FIG. 20B is a perspective view of the dose control assembly of FIG. 19 configured for low output.

In some embodiments, the liquid dispenser 100 includes a dose control assembly 160, a first embodiment of which is shown in FIGS. 2, 13, and 17 and a second embodiment of which is shown in FIGS. 19, 20A, and 20B. In both embodiments, the dose control assembly 160 limits the range of motion of the handle 110 and controls the amount of liquid delivered by the liquid dispenser 100. The dose control assemblies 160 include an adjustment mechanism having at least two step surfaces. In a transient traffic environment a user might want to deliver the minimum amount required for a hand wash to save more money, hence a smaller soap dose. In a non-transient environment, however, such as for staff, students, or employees, the user may want to deliver a larger, more satisfying, or necessary dose of product. As will be discussed, the dose control assembly 160 may be positioned on either side of the rotor assembly 140, as shown in FIG. 13, or in beneath the rotor assembly 140, as shown in FIG. 19.

FIG. 2 depicts the attachment of the dose control assembly 160 to the backing 120. In the first embodiment, the adjustment mechanism of the dose control assembly 160 is a rotary knob 235 that covers a base 240, a post 250, a screw, and a dose control spring 245. The individual elements are shown in the exploded view in FIG. 3. In an embodiment, the base 240 is secured to the backing 120. The base 240 may be secured to the backing 120 by being made integral with the backing 120 or by being secured to the backing 120 in some other manner, such as by adhesive or attachment devices. In an embodiment, the knob 235 covers but is not directly connected to the base 240. The post 250 extends through a hole in the backing 120, through the base 240, and into the knob 235, where the screw secures the knob 235 onto the post 250. The spring 245 is placed on the post 250 and biases the knob 235 towards the base 240. In an embodiment, the spring 245 is compressed between an end of the post 250 and a rear face of the backing 120, thereby biasing the knob 235 towards the base 240. The spring may also be connected directly to the knob 235.

The first embodiment of the dose control assembly 160 is positioned on the backing 120 so that when the handle 110 is actuated, the handle 110 contacts a portion of the dose control assembly 160 and cannot be actuated any further. This limits the rotation of the rotor assembly 140. For example, as shown in FIG. 17, the dose control assembly 160 may have a first step surface 500 that allows the greatest actuation of the handle 110, a second step surface 505 that allows an intermediate actuation of the handle 110, and third step surface 510 that allows the shortest actuation of the handle 110. When the handle 110 is actuated, it is depressed until the handle 110 comes into contact with one of the step surface, at which point the handle 110 cannot be depressed any further. The user can control the actuation distance by rotating the dose control assembly 160 so that the different step surfaces, which are at different distances from the backing 120, are in line with the handle 110. In some embodiments shown in FIG. 13, the handle 110 includes dosage indicators 470 that disclose the relative liquid discharge level for the various step surfaces. It should be understood that three step surfaces is only an example and more or fewer step surfaces and discharge levels may be designed for the liquid dispenser 100.

Figure 18A:
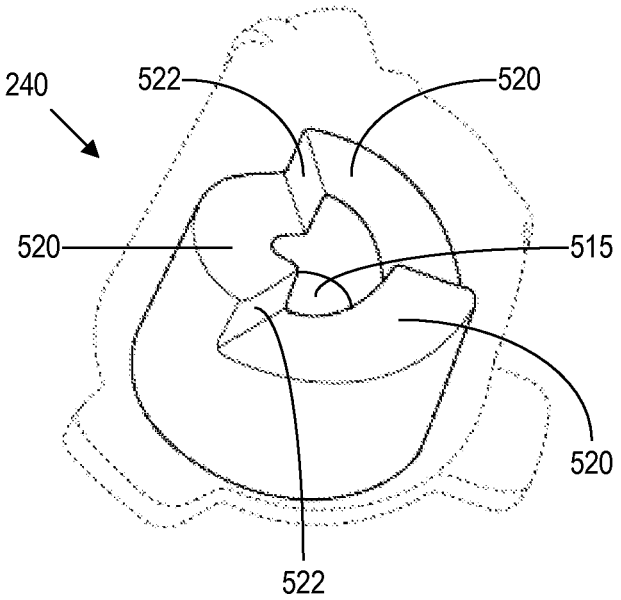
FIG. 18A is a perspective view of the base of the dose control assembly of FIG. 17.
Figure 18B:
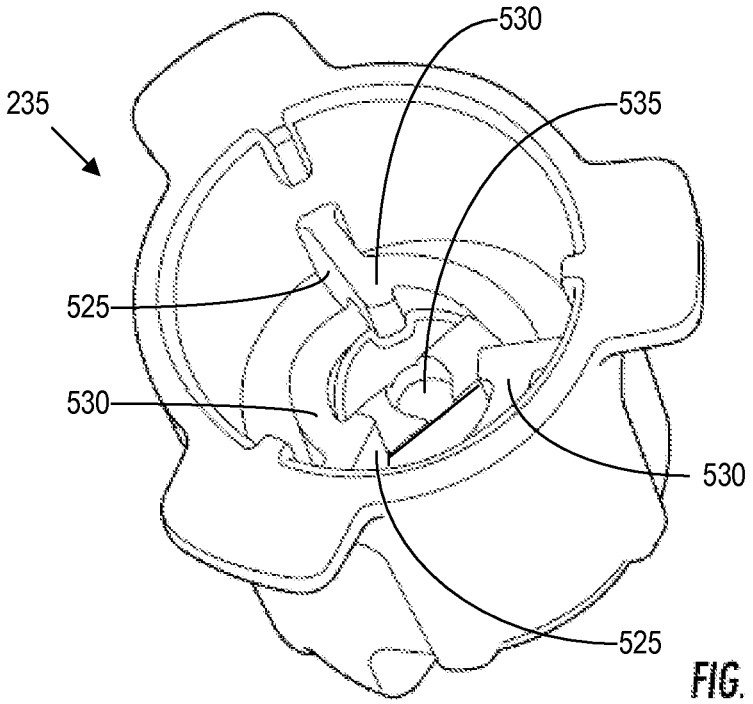
FIG. 18B is a perspective view of the knob of the dose control assembly of FIG. 17.

In some embodiments, the first embodiment of the dose control assembly 160 includes a system to prevent the dose control assembly 160 from being set at discharge levels other than the pre-determined discharge levels. The dose control assembly 160 includes a series of ramps, slides, walls, and stops that allow the knob 235 to be rotated on the base 240 but not set at an intermediate level. For example, FIG. 18A discloses the base 240 having a series of ramps 520 ending at walls 522 around a post shaft 515. The post 250, shown in FIG. 3, extends through the post shaft 515 and attaches, via the screw, to the knob 235 at the post hole 535. The spring 245 biases the knob 235 towards the base 240 but allows the knob 235 to be rotated. As shown in FIG. 18B, the knob 235 includes a series of slides 530 ending at stops 525, wherein the slides 530 are configured to correspond to the ramps 520 on the base 240. The slides 530 on the knob 235 slip over the ramps 520 on the base 240 so that the knob 235 automatically turns, biased by the spring 245, until the walls 522 of base 240 contacts the stops 525 of the knob 235.

A second embodiment of the dose control assembly 160 is shown in FIGS. 19, 20A, and 20B. In the second embodiment the adjustment mechanism of the dose control assembly 160 is a linear slide 542 defining a slot 545, wherein the slot 545 receives at least one adjustor 555, such as a screw or post. The user moves the linear slide 542 laterally so that the adjustor 555 passes through the slot 545. In an embodiment, the slot 545 includes a contoured interior wall that stops the adjuster 555 via frictional engagement with the walls of the slot 545 at pre-determined locations. The pre-determined locations are configured so that in each location a different step surface 560, 565, 570 defined by the linear slide 542 engages the handle 110 during actuation. A high dose step surface 560 allows the handle 110 to be depressed the farthest distance and hence the largest dose of liquid is discharged. A medium dose step surface 565 and a low dose step surface 570 restrict actuation of the handle 110 so that less liquid is discharged. The dose control assembly 160 set to the high dose step surface 560 is shown in FIG. 20A. As illustrated, the handle 110 may be depressed until the handle 110 contacts the high dose step surface 560. The low dose step surface 570 is illustrated in FIG. 20B, wherein the handle 110 is limited to a lower range of motion and thus less liquid is discharged.

Figure 23:
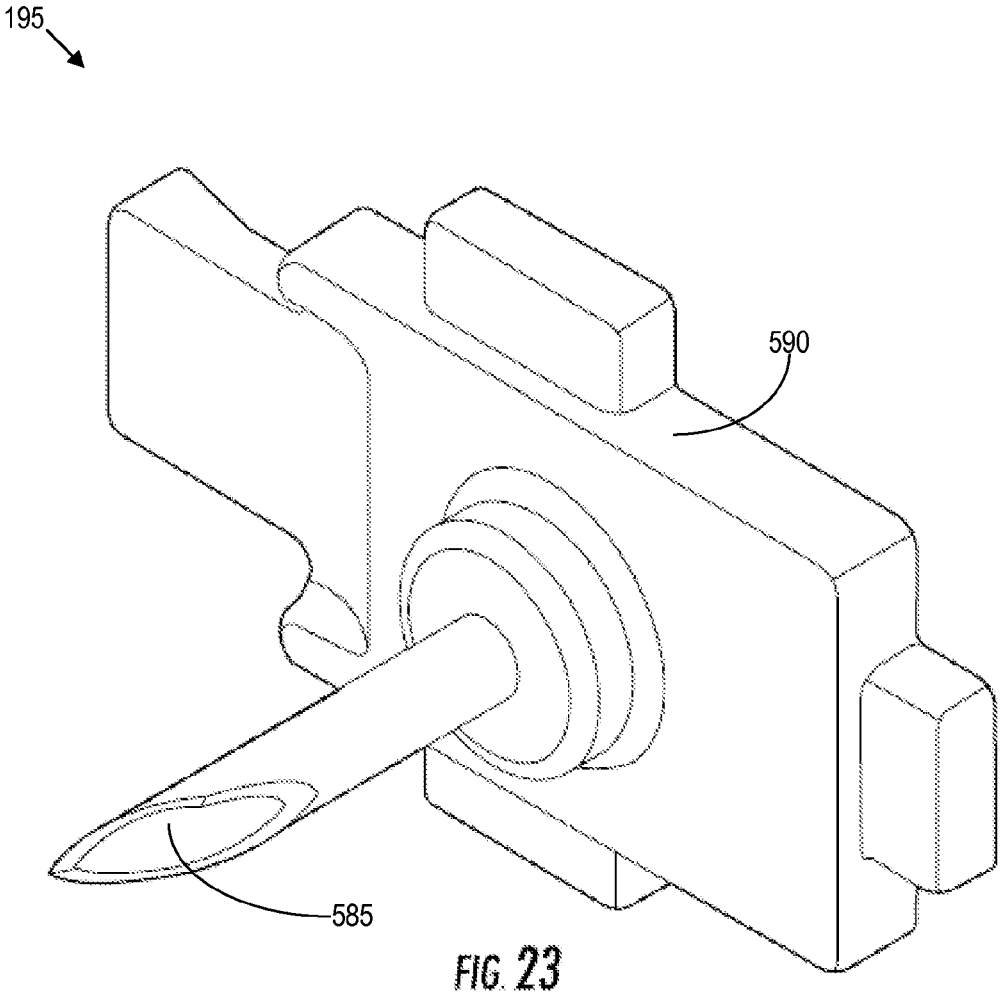
FIG. 23 is a perspective view of a second embodiment of a venting assembly for the liquid dispenser of FIG. 1.
Figure 24A:
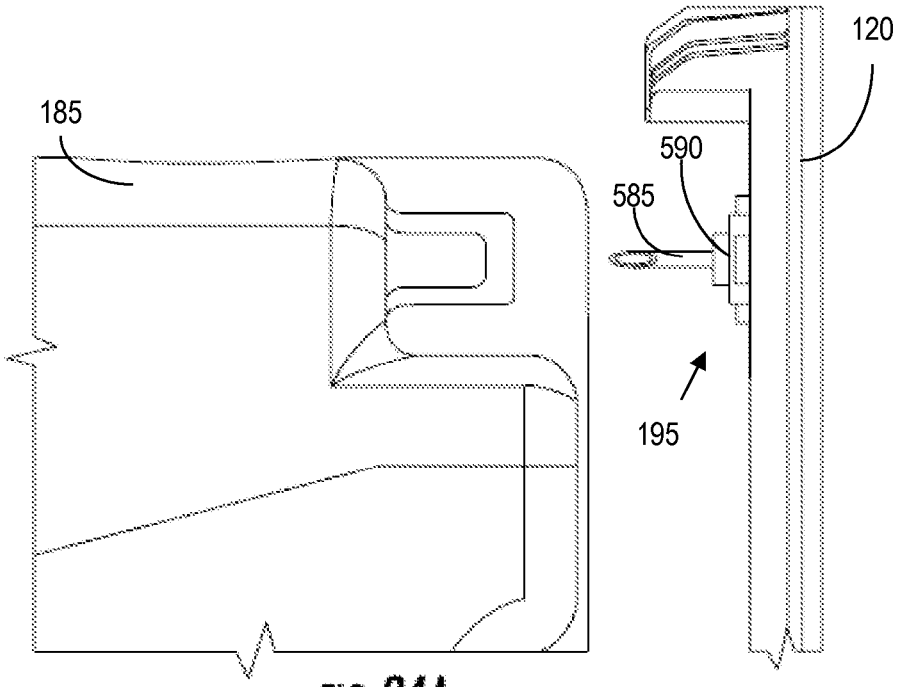
FIG. 24A is a side view of the venting assembly of FIG. 23 before attaching the reservoir.
Figure 24B:
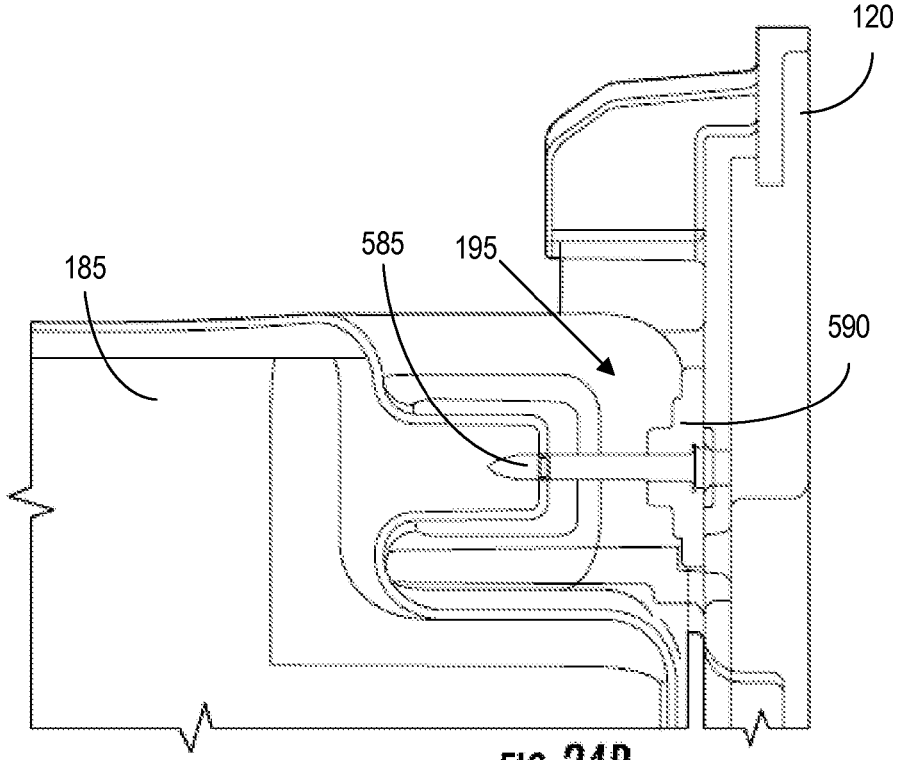
FIG. 24B is a side view of the venting assembly of FIG. 23 after attaching the reservoir.

In some embodiments, the liquid dispenser 100 includes a venting assembly 195, a first embodiment of which is shown in FIGS. 2-4 and 21-22B and a second embodiment of which is shown in FIGS. 23-24B. In both embodiments, the venting assembly 195 vents the reservoir 185 so that a vacuum is not created in the reservoir 185 or reservoir tube 175 during pumping. FIG. 2 depicts the first embodiment of the venting assembly 195 attached to the backing 120. The venting assembly 195 can be made integral with the backing 120 or can be attached to the backing 120, such as by screws or other attachment devices. Various embodiments of venting assemblies are possible, such as blades or needles.

Figure 21:
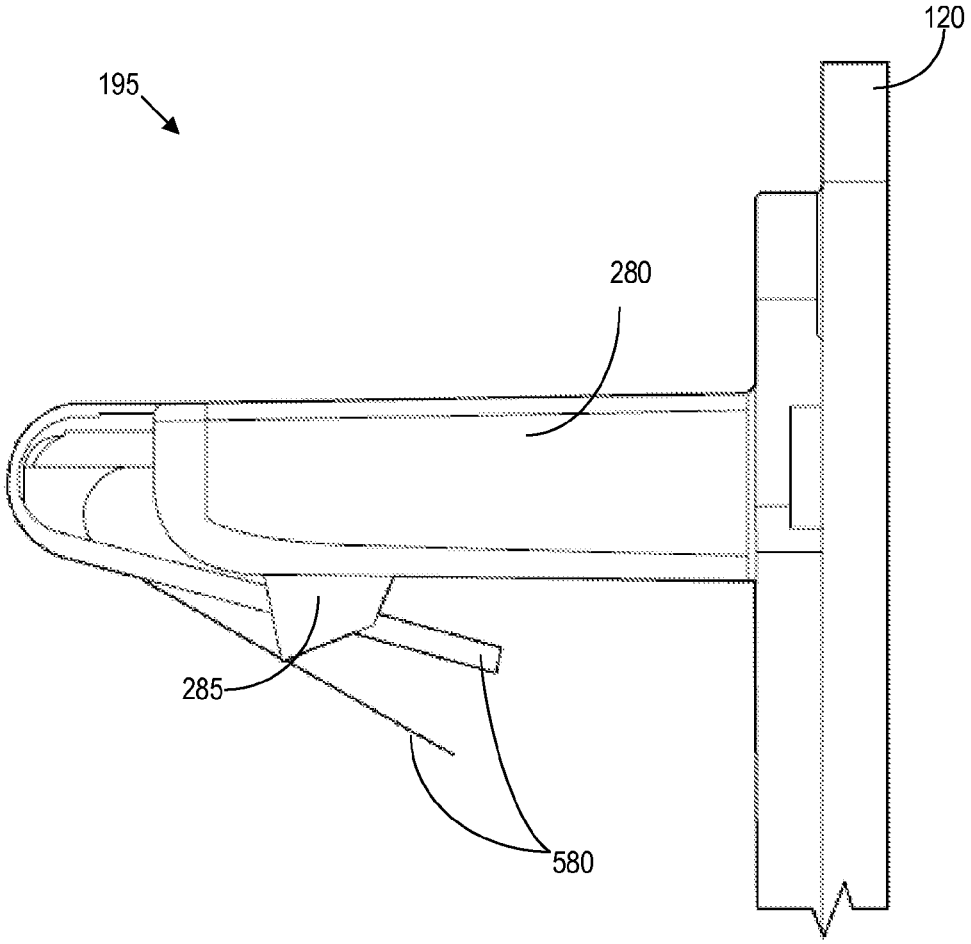
FIG. 21 is a side view of a first embodiment of a venting assembly for the liquid dispenser of FIG. 1.

In the first embodiment of the venting assembly 195 shown in FIGS. 21, 22A, and 22B, a venting body 280 is attached to the backing 120 and a venting blade 285 is attached to the venting body 280. In some embodiments, the venting blade 285 is removable and/or replaceable. The venting assembly 195 may include protective guides 580, such as plastic or metal guides, that reduce the risk of the user being cut when installing the reservoir 185. The protective guides 580 shield the venting blade 285 from casual contact but bend out of the way when the reservoir 185 is mounted onto the backing 120. FIGS. 22A and 22B depict the venting procedure as the reservoir 185 is mounted onto the backing 120. In an embodiment, the venting blade 285 pierces a portion of the reservoir 185. The venting blade 285 may pierce a standard thickness portion, the reservoir 185 may be shaped such that the venting blade 285 pierces a thinner portion of the reservoir 185 wall, or the reservoir 185 may be shaped such that the venting blade 285 pierces a foil cap. FIG. 22B depicts the reservoir 185 after the reservoir 185 has been mounted to the backing 120. As shown, the venting blade 285 pierces the reservoir 185 and allows air to enter. Advantageously, the venting blade 285 enters the upper portion of the reservoir 185 so that liquid does not leak out of the vent.

A second embodiment of the venting assembly 195 is shown in FIGS. 23, 24A, and 24B. A needle 585 or sharp rod projects from the backing 120. The needle 585 may attach to a needle backplate 590, as shown in FIG. 23, or the needle 585 may attach directly to the backing 120 (not shown). In an embodiment, the needle 585 is replaceable if it is bent or dulled through use. For example, the needle backplate 590 may clip or slide into the backing 120 and can be removed. In one embodiment, the needle 585 is hollow and allows air to enter the reservoir 185 through the needle 585. In another embodiment, the needle 585 is solid and allows air to enter the reservoir 185 through the opening formed in the reservoir 185 by the needle 585. When the reservoir 185 is mounted to the backing 120, the needle 585 pierces and vents the reservoir 185. The needle 585 may pierce an induction heat sealed foil (not shown) covering an opening on the reservoir 185. In a still further embodiment, an adhesive label (not shown) covers an opening and may be pierced by the venting assembly 195 or may be peeled off by a user to vent the reservoir 185. In FIG. 24A, the second embodiment of the venting assembly 195 is mounted to the backing 120 and the reservoir 185 is placed on the backing 120. The needle 585 has not yet pierced the reservoir 185. In FIG. 24B, the venting assembly 195 was mounted on the backing 120 and the needle 585 automatically pierced the reservoir 185, thereby allowing liquid to exit the reservoir tube 175 without causing a vacuum in the reservoir 185.

Turning now to FIGS. 25-27, views of the liquid dispenser 100 in operation are provided. FIGS. 25A and 25B are a side view and a cutaway side view of the liquid dispenser 100 with the handle 110 in the neutral position. At this point, the handle 110 has not been actuated. The rotor spring 230 is biasing the ratchet assembly 155 and the handle 110 into the neutral position. In one embodiment shown in FIG. 25B, at least one roller 305 in the rotor assembly 140 is compressing the reservoir tube 175 at all times to reduce the chance that liquid leaks from the reservoir tube 175 in the neutral position. In some embodiments, the reservoir tube 175 ends in the check valve 170, which also reduces the chance that liquid leaks from the reservoir tube 175 in the neutral position.

Figure 26B:
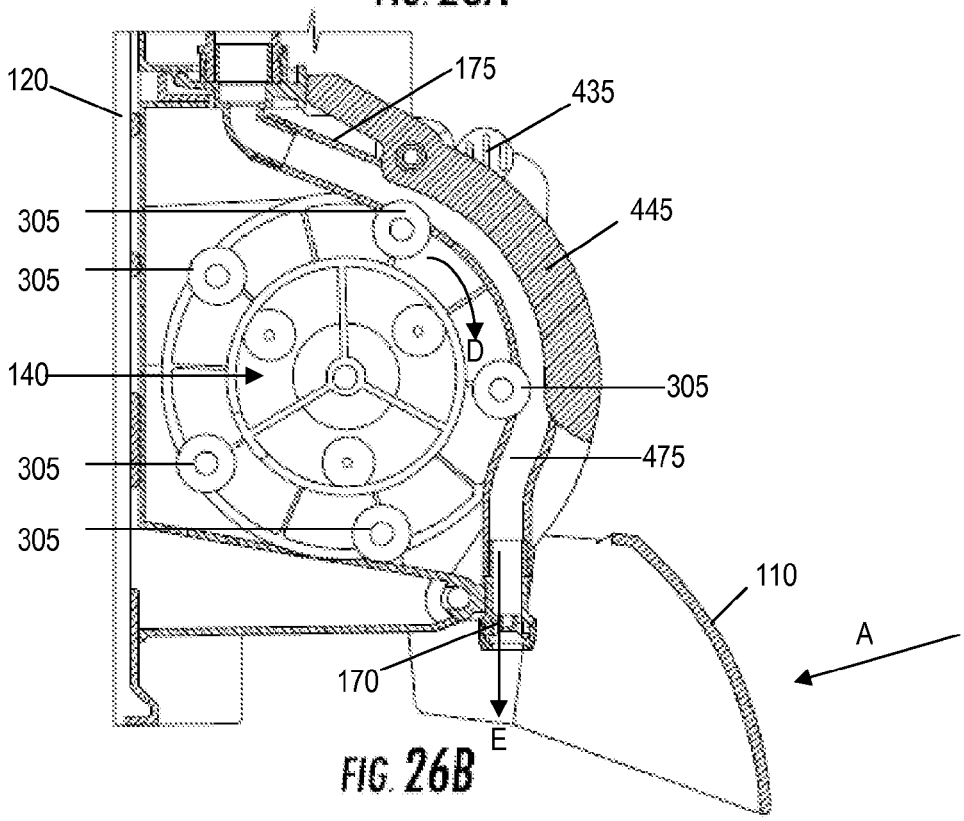
FIG. 26B is a cutaway side view of the liquid dispenser of FIG. 1 when the handle is partially actuated.

FIGS. 26A and 26B are a side view and a cutaway side view of the liquid dispenser 100 when the handle 110 is partially actuated. The user is pressing in on the handle 110 in the direction of arrow A to dispense liquid from the liquid dispenser 100. The handle 110 rotates on the handle pivots 200. The rotor spring 230 deforms so that when the handle 110 is released, the ratchet assembly 155 and handle 110 will return to the neutral position. The handle recesses 210 contact the ratchet rollers 365, causing the ratchet assembly 155 to rotate at the rotor axle 150 in the direction of arrow B. This in turn causes the pawl tip 390 to engage the teeth 350 of the drive gear 330 and rotate the rotor assembly 140 in the direction of arrow C, as shown in FIG. 28. When the ratchet assembly 155 is advanced, the pawl tip 390 catches in between two teeth 350 of the drive gear 330 and causes the drive gear 330 to rotate. The pawl extension 415 contacts the pawl stop 410 so that the pawl 385 is fixed in position when the pawl tip 390 is engaging the drive gear 330. FIG. 26B shows that the rollers 305 advance in the direction of arrow D and compress the reservoir tube 175. Internal pressure in the lumen 475 exceeds the cracking pressure of the check valve 170 and liquid is discharged through the reservoir tube 175 in the direction of arrow E.

Figure 27A:
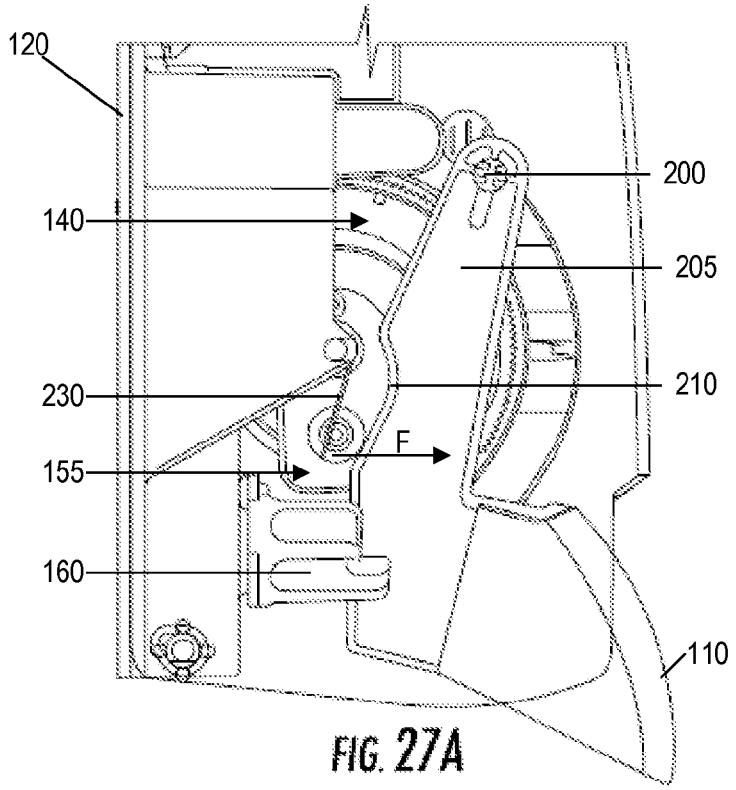
FIG. 27A is a side view of the liquid dispenser of FIG. 1 when the handle is fully actuated.
Figure 27B:
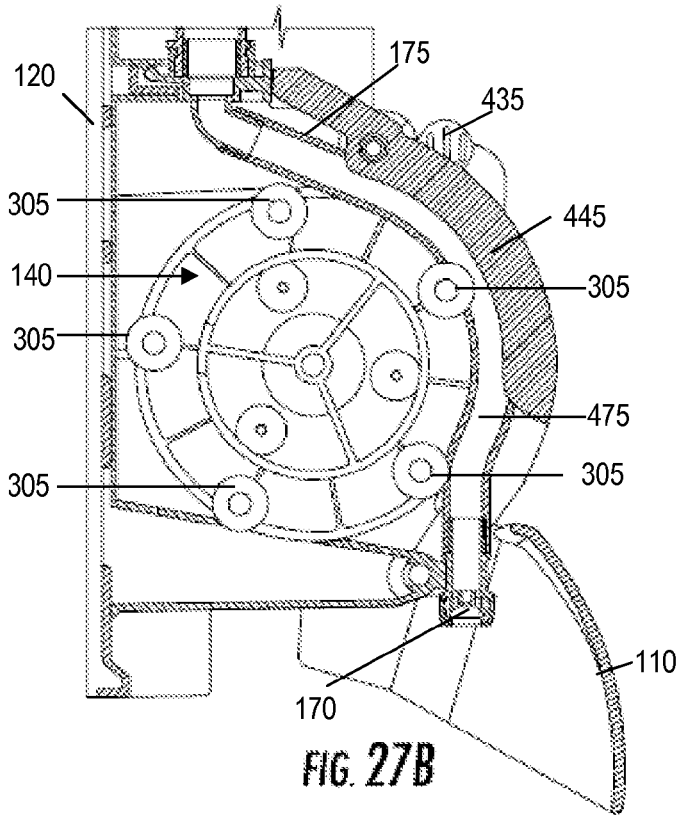
FIG. 27B is a cutaway side view of the liquid dispenser of FIG. 1 when the handle is fully actuated.

FIGS. 27A and 27B are a side view and a cutaway side view of the liquid dispenser 100 when the handle 110 is fully actuated. In an embodiment, the handle 110 is depressed until a portion of the handle 110 contacts the step surface of the dose control assembly 160. When no dose control assembly 160 is present, the handle 110 is depressed as far as possible or as far as desired by the user. The ratchet assemblies 155 and rotor assembly 140 have rotated around the rotor axle 150 as far as possible during the handle actuation. A roller 305 remains in contact with and compressing the reservoir tube 175 against the saddle body 445. At this point, the internal pressure in the lumen 475 is decreasing because the check valve 170 has opened and dispensed liquid. The check valve 170 closes when the internal pressure decreases below the cracking pressure and thus prevents additional liquid from being discharged from the liquid dispenser 100. The handle 110 and the ratchet assemblies 155 move in the direction of arrow F, shown in FIG. 27A, and return to the neutral position of FIGS. 25A, 25B, aided by the rotor spring 230 that has been compressed behind the pawl pin 375. FIG. 29 depicts a detail view of the pawl 385 disengaging from the teeth of the drive gear 330 when the user releases the handle 110. As the rotor spring 230 biases the ratchet assembly 155 back into the neutral position, the pawl tip 390 disengages from the teeth 350 of the drive gear 330 and slips over the teeth 350 in the direction of arrow G. The ratchet spring 380 allows the pawl tip 390 to rotate and slip over the drive gear 330. The ratchet assembly 155 and handle 110 return to the neutral position and the ratchet spring 380 returns the pawl tip 390 of the pawl 385 to a position where, when the handle 110 is again actuated, the pawl tip 390 will engage the drive gear 330.

FIG. 30 depicts an embodiment of the liquid dispenser 100 wherein backward rotation of the rotor assembly 140 is prevented. In some situations, the rotor assembly 140 may rotate backwards, i.e., in the direction that does not advance fluid through the reservoir tube 175 and out of the check valve 170. For example, if negative pressure builds up in the reservoir 185 or reservoir tube 175 during liquid discharge, release of the handle 110, as shown in FIGS. 27A and 27B, may cause rotor backlash. When this occurs, the rollers 305 move in the reverse direction indicated by arrow H and liquid is sucked through the reservoir tube 175 towards the reservoir 185. This causes the reservoir tube 175 to deflate and may contaminate the reservoir 185. Further, the proper dosage will not be dispensed from the liquid dispenser 100 until the reservoir tube 175 is again inflated to the standard diameter. To prevent rotor backlash, the backlash ratchet 595 is positioned on the backing 120, as shown in FIG. 30. The backlash ratchet 595 engages the backlash gear 300 and prevents backwards rotation of the rotor assembly 140. A backlash spring 600 biases the backlash ratchet 595 into contact with the backlash gear 300. When the rotor assembly 140 is rotating in the advance direction, i.e., dispensing liquids, the backlash ratchet 595 slips over the teeth of the backlash gear 300. The backlash spring 600 provides enough flexibility in the positioning of the backlash ratchet 595 so that the rotor assembly 140 is not prevented from rotation in a forward direction. If the rotor assembly 140 moves in the reverse direction, i.e., the handle 110 is released and backlash occurs, the backlash ratchet 595 engages the teeth of the backlash gear 300 and prevents backwards movement.

Advantages of the liquid dispenser 100 include accurate dispensing of liquids, control over the amount of liquid that will be dispensed, and ease in replacing the liquid reservoirs. The user of the liquid dispenser 100 is able to control the amount of liquid dispensed during a single handle actuation, thus ensuring an adequate amount for the user's needs while also reducing waste. At the same time, the user can modify the amount of liquid that will be dispensed so that if different amounts are needed a new dispenser or multiple pumps of the dispenser are not necessary. Further, the reservoir assembly 485 in the liquid dispenser 100 can be easily replaced by the user. These advantages of the liquid dispenser 100 are clear upon consideration of the disclosure herein.

While embodiments of the invention are disclose herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A dispenser comprising:

a reservoir configured to contain a liquid and a reservoir tube operably connected to the reservoir and configured to dispense liquid from the reservoir;

a compression element on a rotor assembly, wherein the compression element compresses the reservoir tube when the rotor assembly rotates;

a drive gear operably connected to the rotor assembly and configured to rotate the rotor assembly about an axle;

a pawl configured to engage the drive gear when advanced in a first direction; the pawl being pivotably mounted on a housing where the housing rotates about the axle, and a ratchet spring for biasing the pawl toward a first position;

a drive mechanism operably connected to the housing for rotating the housing about the axle for moving the pawl in the first direction;

a backlash ratchet configured to engage a gear on the rotor assembly that prevents the rotor assembly from rotating in a second direction, wherein the second direction is opposite the direction the rotor assembly rotates when the pawl engages the drive gear, the gear having a larger diameter than the drive gear.

2. The dispenser of claim 1, wherein the drive mechanism is a manually-actuated handle.

3. The dispenser of claim 1, wherein the compression element comprises a roller where the reservoir tube is compressed between the roller and a saddle body.

4. The dispenser of claim 3, wherein a portion of the saddle body is concave in a direction substantially perpendicular to the reservoir tube.

5. The dispenser of claim 3, wherein the saddle body is movably mounted between a first position where the reservoir tube is compressed between the roller and a saddle body and a second position remote from the rotor assembly.

6. The dispenser of claim 1, wherein the reservoir tube connects the reservoir to a check valve.

7. The dispenser of claim 1, wherein the rotor assembly compresses the reservoir tube a fixed amount dependent upon the distance the drive gear is advanced in the first direction.

8. The dispenser of claim 6, wherein the pawl engages a tooth on the drive gear of the rotor assembly.

9. The dispenser of claim 1, wherein the liquid dispenser further comprises a venting assembly configured to pierce the reservoir.

10. The dispenser of claim 9, wherein the venting assembly comprises a venting device selected from a group consisting of a venting blade and a needle.

11. The dispenser of claim 1, wherein drive mechanism comprises a handle and the liquid dispenser further comprises a dose control assembly configured to control the distance the handle is actuated wherein the handle may be moved a first distance to dispense a first amount of liquid and a second distance to dispense a second amount of liquid.

12. The dispenser of claim 11, wherein the dose control assembly comprises an adjustment mechanism comprising a first step surface and a second step surface, wherein the adjustment mechanism moves between a position wherein the handle contacts the first step surface and a second position wherein the handle contacts the second step surface.

13. The dispenser of claim 11, wherein the adjustment mechanism is selected from the group consisting of a rotary knob and a linear slide.

14. he dispenser of claim 1, wherein the compression element comprises a roller.

15. The dispenser of claim 14, wherein the roller is one of a plurality of rollers positioned a fixed distance from an axis of the rotor assembly wherein the plurality of rollers compress the reservoir tube when the rotor assembly rotates.

16. The dispenser of claim 1: wherein said drive mechanism moves the pawl a predetermined distance to rotate the rotor assembly through a predetermined angle, the predetermined angle determining an amount of liquid dispensed from the dispenser tube.

17. The dispenser of claim 16, wherein the plurality of rollers are equally spaced on the periphery of the rotor assembly.

* * * * *